US008157337B2

(12) United States Patent
Manalang et al.

(10) Patent No.: US 8,157,337 B2
(45) Date of Patent: Apr. 17, 2012

(54) TOOL BOX STORAGE ASSEMBLY

(76) Inventors: Edwin Dizon Manalang, Burbank, IL (US); Larry Mitchell Grela, Plainfield, IL (US)

( * ) Notice: Subject to any disclaimer, the term of this patent is extended or adjusted under 35 U.S.C. 154(b) by 229 days.

(21) Appl. No.: 12/456,414

(22) Filed: Jun. 16, 2009

(65) Prior Publication Data

US 2010/0314978 A1 Dec. 16, 2010

(51) Int. Cl.
*A47B 81/00* (2006.01)

(52) U.S. Cl. ..... 312/249.8; 312/249.11; 312/290; 280/47.35; 211/70.6

(58) Field of Classification Search ..... 220/4.27, 220/8, 503, 528; 206/508, 503; 312/293.1, 312/249.1, 249.8, 249.11, 293.3, 298, 301, 312/308, 309, 21, 22–30, 283, 284, 285, 312/290, 328, 330.1, 243, 249, 223.6, 317.3, 312/333, 289, 287; 280/651, 47.17–47.19, 280/47.34, 47.35, 79.11, 79.2; 211/70.6, 211/69, 60.1, 70.2, 70.7, 87.01, 119.003
See application file for complete search history.

(56) References Cited

U.S. PATENT DOCUMENTS

| | | | | | |
|---|---|---|---|---|---|
| 128,439 | A | * | 6/1872 | Unna | 312/204 |
| 138,279 | A | * | 4/1873 | Pert | 312/202 |
| 315,108 | A | * | 4/1885 | Bailey | 312/301 |
| 652,778 | A | | 7/1900 | James | |
| 898,106 | A | | 9/1908 | Higgins | |
| 1,061,646 | A | * | 5/1913 | Welliver | 312/301 |
| 1,104,917 | A | * | 7/1914 | Miller | 312/278 |
| 1,108,082 | A | * | 8/1914 | Pennock | 312/226 |
| 1,113,832 | A | | 8/1914 | Roth | |
| 1,281,923 | A | * | 10/1918 | Fales | 312/317.2 |
| 1,414,826 | A | | 5/1922 | Meyerson | |
| 1,514,885 | A | | 3/1924 | Bigler | |
| 1,510,240 | A | | 9/1924 | Carrier | |
| 1,684,889 | A | * | 9/1928 | Russ | 312/286 |
| 1,703,627 | A | * | 2/1929 | Labadie et al. | 190/17 |
| 1,867,907 | A | * | 7/1932 | Dawson | 312/323 |
| 1,930,617 | A | * | 10/1933 | Huot | 206/379 |
| 1,984,345 | A | | 12/1934 | Kennedy | |
| 1,987,822 | A | | 1/1935 | Gregory | |
| D99,541 | S | * | 5/1936 | Dean | D34/21 |
| 2,171,772 | A | * | 9/1939 | Viehmann | 312/286 |
| 2,286,427 | A | | 6/1942 | Levensten | |
| 2,327,761 | A | * | 8/1943 | Brodbeck | 312/334.15 |
| 2,353,059 | A | * | 7/1944 | Murray | 312/286 |
| 2,525,208 | A | | 9/1946 | Clink | |
| 2,565,784 | A | * | 8/1951 | Sheean | 312/286 |
| 2,608,305 | A | * | 8/1952 | Sager | 211/49.1 |
| 2,716,046 | A | * | 8/1955 | Minturn | 312/286 |
| 2,750,242 | A | * | 6/1956 | Viehmann | 108/83 |
| 2,880,918 | A | | 4/1959 | Schweikhard | |
| 2,996,192 | A | | 12/1959 | Dell et al. | |
| 2,995,256 | A | | 8/1961 | Schoenfisch | |

(Continued)

OTHER PUBLICATIONS

International Search Report for PCT Application No. PCT/US2010/001732.

(Continued)

*Primary Examiner* — Darnell Jayne
*Assistant Examiner* — Stanton L Krycinski
(74) *Attorney, Agent, or Firm* — John G. Chupa

(57) ABSTRACT

A storage assembly 10 which has a plurality of unique storage components 12, 14, and 800 which may be selectively connected in order to provide an optimal storage solution for a wide variety of applications.

6 Claims, 23 Drawing Sheets

U.S. PATENT DOCUMENTS 3,013,853 A * 12/1961 Toms ..... 312/303
3,092,428 A * 6/1963 Kerschner ..... 312/218
3,179,255 A * 4/1965 De Caccia ..... 211/70.6
3,259,230 A 7/1966 Jaeger
3,462,208 A 8/1969 Black et al.
3,520,583 A 7/1970 Case
3,558,205 A 1/1971 Mueller
3,658,398 A * 4/1972 Abbate et al. ..... 312/333
3,848,942 A 11/1974 Fanini
3,954,202 A 5/1976 Petrick
4,002,385 A * 1/1977 Hone ..... 312/286
4,108,514 A 8/1978 Zimmerman
4,155,460 A * 5/1979 Ratti ..... 211/70.6
425,215 A 4/1980 Franklin
4,203,525 A * 5/1980 Okubo ..... 220/4.26
4,211,455 A * 7/1980 Tedrow ..... 312/198
4,266,835 A * 5/1981 Schmidt ..... 312/244
4,285,556 A * 8/1981 Loeffel ..... 312/244
4,288,132 A 9/1981 Znamirowski et al.
4,303,158 A * 12/1981 Perkins ..... 206/373
4,333,623 A * 6/1982 May ..... 248/176.2
4,365,720 A * 12/1982 Kaneshiro ..... 211/70.6
4,446,972 A * 5/1984 Sussman ..... 211/26
4,614,384 A 9/1986 Takano et al.
4,643,494 A * 2/1987 Marleau ..... 312/111
4,733,703 A 3/1988 Cimino
4,821,143 A 4/1989 Holmgren et al.
4,836,626 A 6/1989 Taylor et al.
4,895,008 A * 1/1990 Blake ..... 70/86
4,976,450 A * 12/1990 Ellefson ..... 280/79.11
4,993,786 A * 2/1991 De Giulio ..... 312/298
4,998,698 A * 3/1991 Martinson ..... 248/176.2
5,044,059 A * 9/1991 De Giulio ..... 29/401.1
5,244,265 A * 9/1993 Chiang ..... 312/107
5,244,272 A * 9/1993 Thompson ..... 312/334.23
5,257,860 A 11/1993 Slivon
5,403,139 A 4/1995 Slivon et al.
5,443,311 A * 8/1995 Kadlecek et al. ..... 312/308
5,462,348 A * 10/1995 Ellingson et al. ..... 312/301
5,468,062 A * 11/1995 Finnegan ..... 312/301
5,468,063 A * 11/1995 Simonek ..... 312/334.28
5,586,816 A * 12/1996 Geiss, II ..... 312/301
5,588,659 A * 12/1996 Boes et al. ..... 280/47.19
5,590,940 A * 1/1997 Richard ..... 312/287
5,615,782 A * 4/1997 Choe ..... 211/70.6
5,632,388 A * 5/1997 Morrison et al. ..... 211/74
5,634,649 A * 6/1997 Breining et al. ..... 280/47.35
5,645,332 A 7/1997 Snoke et al.
5,720,535 A 2/1998 Mehman
5,765,842 A * 6/1998 Phaneuf et al. ..... 280/47.35
5,816,550 A 10/1998 Watanabe et al.
5,851,059 A * 12/1998 Cirocco ..... 312/334.11
5,857,757 A * 1/1999 Bieker et al. ..... 312/351.3
5,862,689 A 1/1999 Wen
5,927,838 A 7/1999 Hellman
5,927,839 A * 7/1999 Alfaro ..... 312/301
5,951,129 A * 9/1999 Stein ..... 312/249.13
6,039,417 A 3/2000 Snoke et al.
6,076,906 A 6/2000 Royal
6,086,176 A * 7/2000 Aoyama ..... 312/286
6,095,532 A 8/2000 Martin
6,109,709 A 8/2000 Holcomb et al.
6,131,929 A * 10/2000 Haley ..... 280/47.34
6,152,552 A 11/2000 Snoke et al.
6,283,292 B1 9/2001 Chen
6,341,511 B1 1/2002 Snoke et al.
6,374,649 B1 4/2002 Holcomb et al.
6,375,235 B1 4/2002 Mehmen
6,409,187 B1 6/2002 Crow, Jr.
6,422,386 B1 7/2002 Weise et al.
6,719,384 B1 * 4/2004 Parise et al. ..... 312/249.9
6,736,265 B2 5/2004 Kipper et al.
6,843,488 B1 * 1/2005 Tseng ..... 280/47.35
6,851,286 B2 2/2005 Dube et al.
6,935,641 B2 8/2005 Hahn
7,121,638 B1 10/2006 Eggert et al.
7,204,374 B2 * 4/2007 Marek ..... 211/70.6
7,249,812 B2 * 7/2007 Fulop ..... 312/122
7,296,808 B2 11/2007 Huguet
RE40,267 E * 4/2008 Mehmen ..... 292/128
D574,628 S 8/2008 Grela
7,510,078 B2 * 3/2009 Schmidt et al. ..... 206/372
D596,399 S 7/2009 Decarlo et al.
8,083,253 B1 * 12/2011 Butler ..... 280/651
2003/0210517 A1 11/2003 Syring et al.
2004/0104037 A1 * 6/2004 Solet ..... 174/50
2004/0195790 A1 10/2004 Wong Hahn
2005/0204646 A1 9/2005 Tupper et al.
2006/0062415 A1 * 3/2006 Hesketh ..... 381/333
2006/0065563 A1 * 3/2006 Schmidt et al. ..... 206/372
2006/0220503 A1 * 10/2006 Widrig ..... 312/218
2007/0013280 A1 1/2007 Retchloff
2007/0080511 A1 4/2007 Campbell
2007/0103039 A1 * 5/2007 Holcomb et al. ..... 312/107
2007/0222166 A1 9/2007 Ruiz
2007/0274042 A1 11/2007 Jackson et al.
2008/0164791 A1 7/2008 Parise et al.

OTHER PUBLICATIONS

Matco Tools Catalog at least as early as Feb. 6, 2009.
United States Trademark Registration No. 3,930,484.
Matco Tools Catalog at least as early as Jan. 1, 1996.
PCT Search Report of Aug. 12, 2009 for PCT/US2008/003543.
Matco catalog and material.
International Search Report No. PCTUS2010/001732 dated Jul. 8, 2010.
Snap On Cataloge dated Apr. 6, 2009.

* cited by examiner

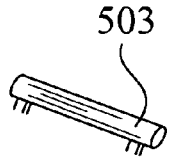
Fig. 5
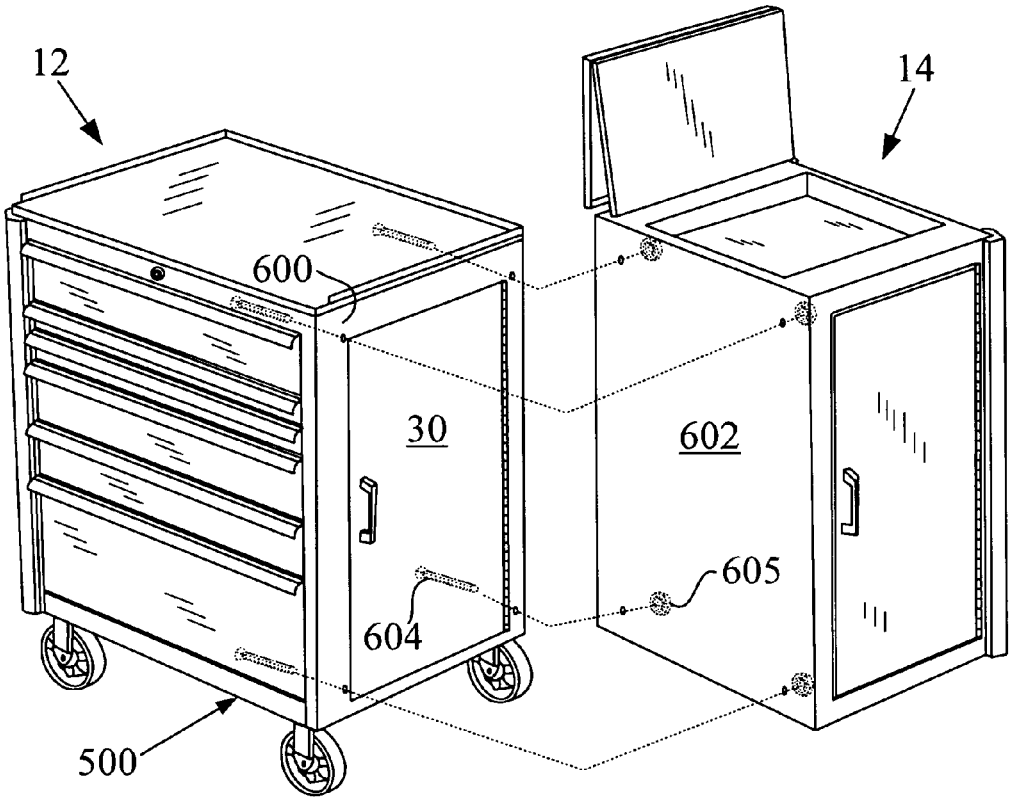

26
1310
1315
1307
1309
1311
1320
1313
1314
1325
1322
1600

1301,
1303
1305

1407
1500
1501
1401
1432
1410
1502
70
1303
1430
1500
1501
1400
1300
1503
1405
1710
1301

1576
1360

1340
1690

Fig. 40
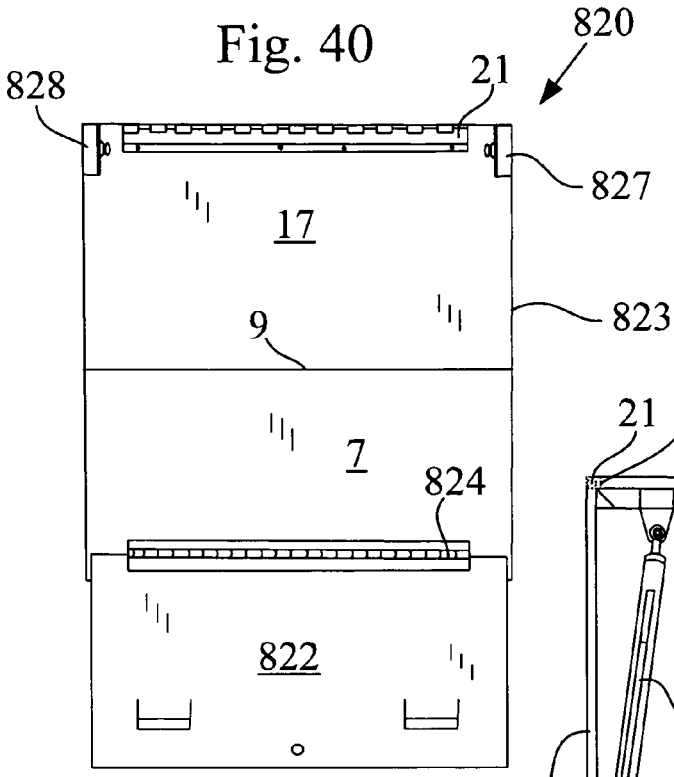
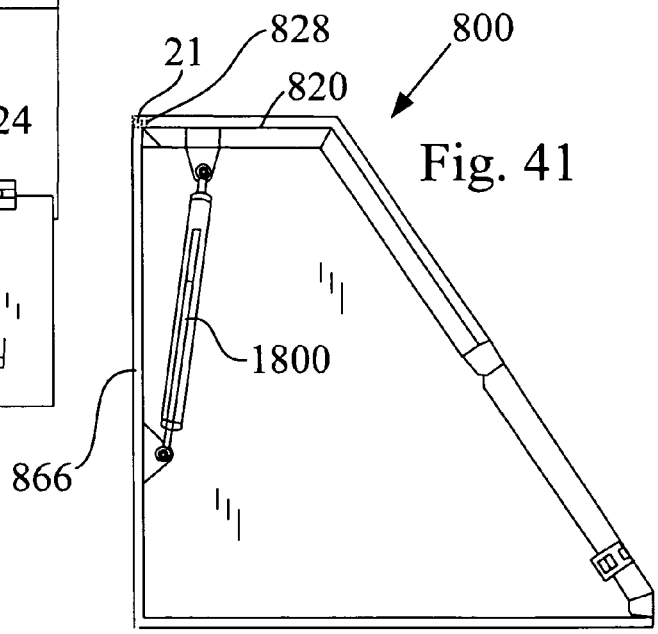
Fig. 41
Fig. 42
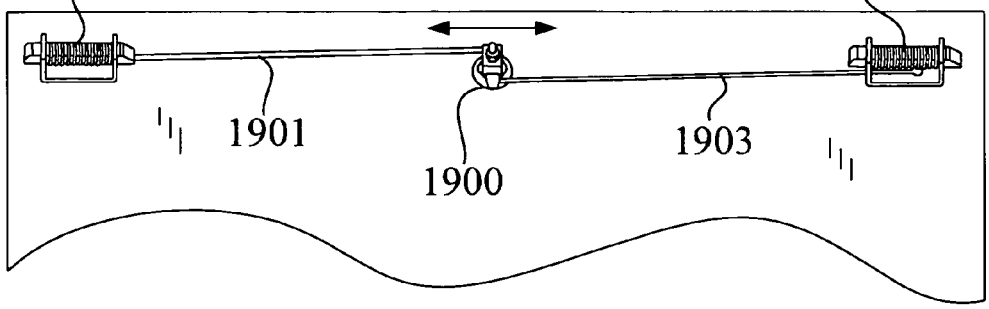

TOOL BOX STORAGE ASSEMBLY

GENERAL BACKGROUND

1. Field of the Invention

The present invention generally relates to a tool box storage assembly and more particularly to a tool box storage assembly having components which cooperatively allow the assembly to be selectively formed in a wide variety of configurations to meet the needs of a diverse group of users and applications.

2. General Background

Toolbox storage assemblies are generally used to selectively store tools and other items in order to allow these stored tools and other items to be selectively retrieved for use in certain applications. After use they must be re-stored until needed again. One non-limiting example of such an application involves the selective storing and use of automotive tools.

While such toolbox assemblies do allow certain items to be stored and later retrieved, they suffer from some drawbacks. By way of example and without limitation, these prior and current toolbox assemblies are usually of a fixed configuration and while this storage configuration may be fine for a certain type or amount of items, it may be unsuitable for other applications having different numbers and shapes of tools and implements. Storage needs change over time, and a "fixed type" of configuration may need to be replaced over time, to meet these ever changing needs, thereby undesirably increasing cost and expense to the user. Moreover, these prior and current toolbox assemblies are not readily adapted to address the needs of a wide variety of dissimilar applications and therefore their overall utility is impaired.

There is therefore a need for and it is a non-limiting object of the present inventions to provide a tool box assembly which may have a variety of selectable storage configurations which allow the tool box assembly to serve the needs of a wide variety of dissimilar applications and users and to meet the ever-changing needs of a user. These and other non-limiting objects are met by the various inventions detailed below.

SUMMARY OF THE INVENTION

It is a first non-limiting object of the present invention to provide a tool box assembly which overcomes some or all of the previously delineated drawbacks of prior and currently utilized tool box assemblies.

It is a second non-limiting object of the present invention to provide a tool box assembly which overcomes some or all of the previously delineated drawbacks of prior and currently utilized tool box assemblies and which, by way of example and without limitation, allow a variety of dissimilar applications and needs to be addressed.

It is a third non-limiting object of the present invention to provide a tool box assembly which allows for the selective use of a base storage component and at least one of a top and a side storage component, each of the top and side components being adapted to be easily and removably attached to the base storage component.

According to a first non-limiting aspect of the present invention, a tool box assembly is provided and includes a first cabinet assembly; a plurality of wheels which are operatively coupled to the first cabinet assembly; a second cabinet assembly which is removably and selectively coupled to a first surface of the first cabinet assembly; and a hutch which is removably and selectively coupled to a second surface of the first cabinet assembly.

According to a second non-limiting aspect of the present invention, a tool box assembly is provided and includes a first cabinet assembly; a plurality of wheels which are operatively coupled to the first cabinet assembly; and a side cabinet assembly which is selectively coupled to the first cabinet assembly and which includes an internal storage cavity and a door which is selectively movable from a first closed position to a second extended position and wherein the door includes a back surface which communicates with the internal storage cavity when the door is placed in the closed position and which includes a pair of substantially similar and linearly coextensive tracks; and a plurality of trays which are selectively and removably coupled to the tracks, and wherein at least one of the plurality of trays has a first top surface which has a plurality of holes and a second open bottom surface.

According to a third non-limiting aspect of the present invention, a tool box assembly is provided and includes a base portion having a plurality of stacked drawers which are each selectively movable from a first respective closed position to a second respective open position, wherein the base portion includes an internal cavity into which the plurality of drawers are movably disposed; a side door which is selectively movable from a first closed position in which the door overlays the plurality of drawers and cooperates with the plurality of drawers to form an internal storage cavity, to second open position in access to the internal storage cavity is allowed; a plurality of wheels which are coupled to the base portion; and a top hutch portion which is removably attached to the base portion.

These and various other aspects, advantages, and objects of the various inventions will become apparent from a reading of the detailed description of the preferred embodiment of the invention, including but not limited to the subjoined claims, and by reference to the included drawings.

BRIEF DESCRIPTION OF THE DRAWINGS

FIG. 5 is perspective unassembled view of the bottom and side cabinets which are shown in FIG. 1.

FIG. 40 is a top and unassembled view of a ninth portion of the hutch portion which is shown in FIG. 26.

FIG. 41 is a side view of a tenth portion of the hutch portion which is shown in FIG. 26.

FIG. 42 is a top view of an eleventh portion of the hutch portion which is shown in FIG. 26.

DETAILED DESCRIPTION OF THE PREFERRED EMBODIMENTS OF THE INVENTION

Figure 1:
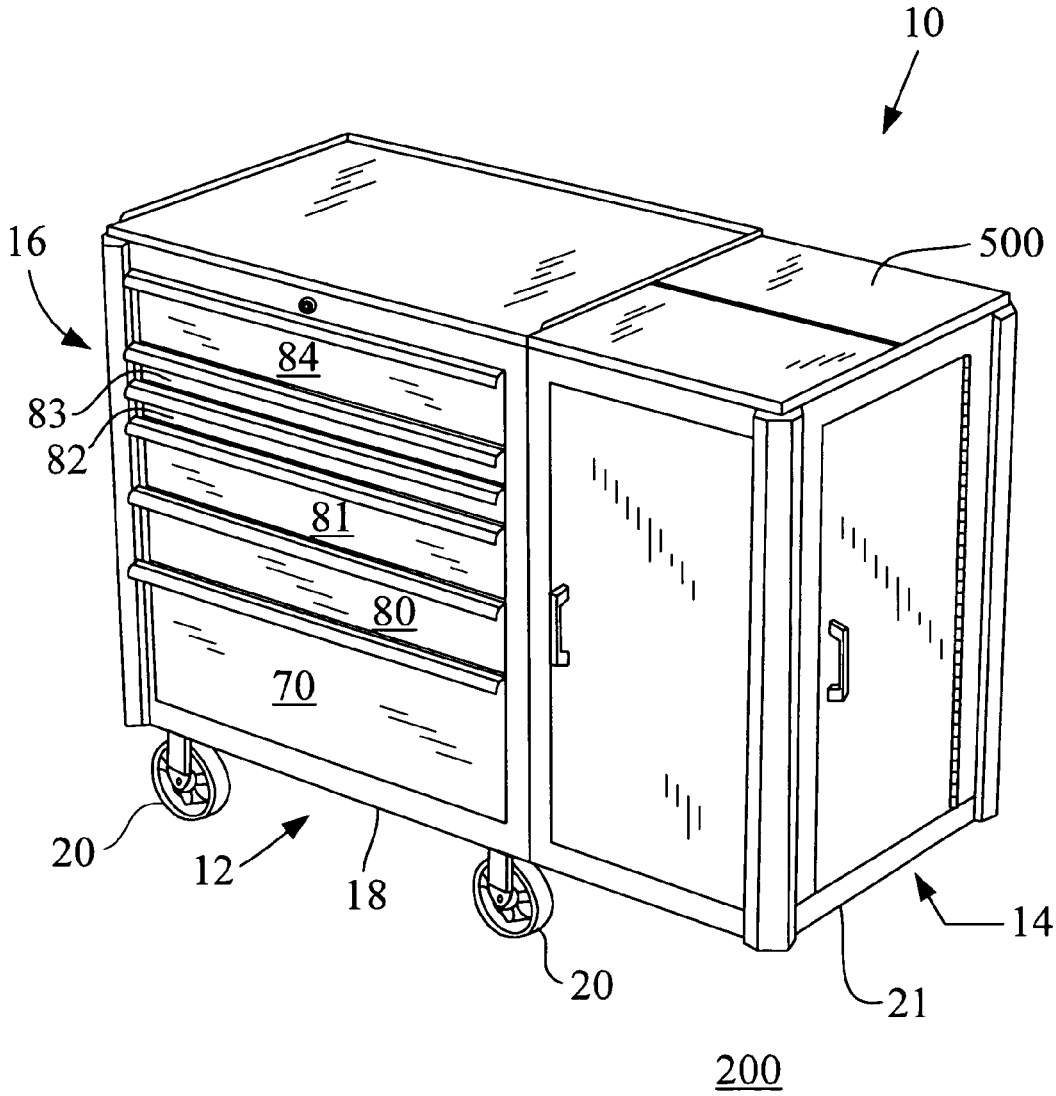
FIG. 1 is a perspective view of a tool box storage assembly which is made in accordance with the teachings of a preferred, although non-limiting, invention and which further depicts the selective combination of a bottom cabinet and a side cabinet assembly which are each made in accordance with the teachings of the preferred embodiment of the inventions.

Referring now to FIG. 1, there is shown a tool box assembly 10 which is made in accordance with the teachings of the preferred, although non-limiting embodiment of the invention.

In this non-limiting preferred embodiment, the assembly 10 includes a base or central cabinet or storage portion 12 and a side cabinet or storage cabinet 14 which is selectively and removably coupled to the portion 12 as will be more fully explained or delineated later. That is, each portion 12, 14 may respectively be used on a "stand-alone" basis or selectively joined in order to meet a wide range of ever changing user needs. Portions 12 and 14 are therefore independent, but selectively "joinable" storage components.

Particularly, the portion 12 includes a hollow and generally cubic shaped body 16 having a bottom surface 18 to which a plurality of substantially identical wheels 20 are coupled. In the most preferred embodiment of the invention, four such wheels 20 are deployed upon the surface 18 (i.e., each unique corner of the surface 18 has a unique one of the wheels 20 operatively deployed upon it). In a similar manner, wheels may be operatively disposed upon bottom surface 21 of side cabinet 14.

Figure 10:
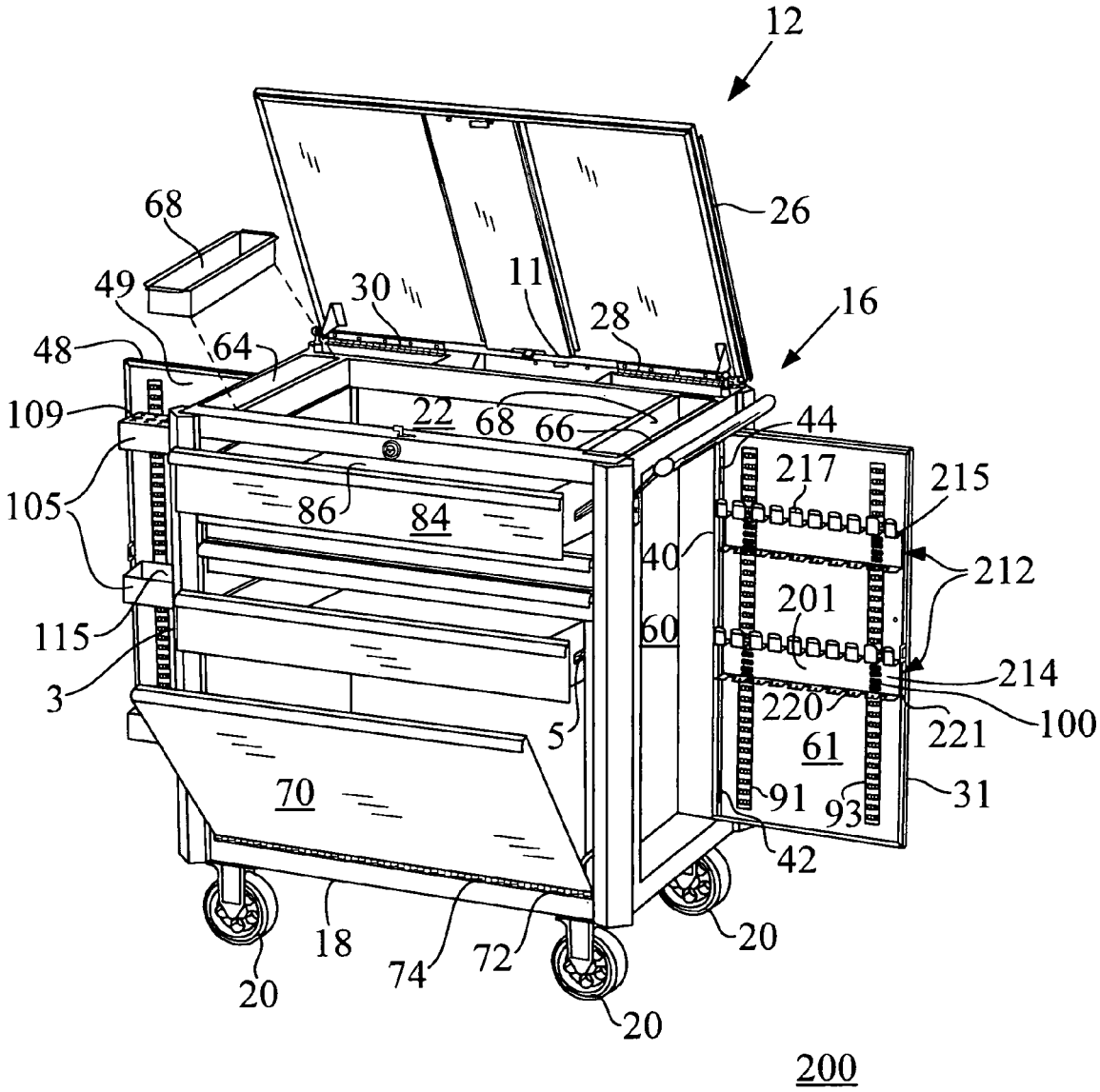
FIG. 10 is a partially unassembled perspective view of the bottom cabinet which is shown in FIG. 1 and further shown in a selective open position.

As is perhaps shown best in FIGS. 1 and 10, the hollow body 16 of base or central cabinet 12 forms a central storage cavity 22 which is adapted to allow various items to be removably placed, for storage, and then to be retrieved for use in a particular application. After use, these items may be returned to the storage cavity 22, until needed again. The body 16 includes a generally flat top portion 26 which is coupled to the edge 11 of the body 16 by a pair of substantially identical hinges 28, 30 and is therefore selectively movable from a first open position, shown in FIG. 10, in which the top portion 26 exposes the central cavity 22, to a closed position in which the top portion 26 overlays and closes the cavity 22.

The body 16 further includes a first generally flat side door 31 which is coupled to the body 16 along edge 40 by the use of a pair of substantially identical hinges 42, 44, and a second side door 48 which is substantially identical to the side door 31 and which is also hingedly coupled to the body 16. Side door 31 is selectively movable from first open position, shown in FIG. 10 in which the door 31 is remote from the rest of the body 16, to a second closed position in which the door 31 wholly lies in a plane which is perpendicular to the plane containing the top 26 when the top 26 is in a selectively closed position. Similarly, the side door 48 is also selectively movable from a first open position which is shown in FIG. 10 and in which the side door 48 is remote from the rest of the body 16, to a second closed position in which the door 48 wholly lies in a plane which is perpendicular to the plane which contains the top 26 when the top 26 is in a selectively closed position. The side doors 31, 48 lie upon opposite sides of the body 16.

Further, in the most preferred although non-limiting embodiment of the invention, a rib panel 60 is formed and/or disposed within the body 16 to prevent communication between the internal storage cavity 22 and the door 31. That is, when the door 31 is in a selective open position, the panel 60 prevents communication with and access to the internal storage cavity 22, through the open door 31. A similar panel (not shown) is also disposed within the body 16 to prevent communication between the internal storage cavity 22 and the door 48 and to prevent access to the internal storage cavity 22 when the door 48 is placed in a selective open position. Moreover, it should be apparent that the door 31 and the panel 60 cooperate to form a second storage compartment located between the internal door surface 61 and the panel 60, and that a similar side storage compartment is formed between the internal surface 49 of the door 48 and the panel with which it communicates (not shown). These two secondary storage compartments increase the amount of overall storage space provided by the assembly or component 12 and are respectively formed when the doors 31, 48 are respectively closed.

Additionally, in the most preferred although non-limiting embodiment of the invention, a pair of substantially identical pockets 64, 66 are formed within the body 16 and these pockets 64, 66 are generally rectangular and are each adapted to selectively and removably receive an insert or trough 68. Each insert 68 is selectively and removably placed within one of the pockets 64, 66 and these removable inserts are adapted to selectively receive and store parts and items for use within one or more applications. The removable nature of the inserts or troughs 68 allows the contained items and material to be easily and quickly transported to the place where the contained items are needed or to a place where items are located which are to be placed in the insert(s) 68. The removable nature of the inserts or troughs 68 enhances the usefulness of the assembly 12.

The body 16 further includes a generally flat front door 70 which is coupled to the body 16 along edge 72 by a hinge member 74 and which is movable from a first open position (shown in FIG. 10) in which access to the central storage compartment 22 is allowed, to a second closed position in which the door 70 overlays the storage compartment 22. The body 16 also includes drawers 80, 81, 82, 83, and 84 which are each movably deployed within the body 16 by the use of respective and opposed tracks 3, 5 and which are each independently movable from a respective closed position in which the drawers respectively 80-84 reside within the internal storage cavity 22, to a respective open position in which the respective containment cavity 86 is removed from the internal storage cavity 22 and exposed. Respective track pairs 3, 5 are fixed to opposed sides of a drawer 70,80,81, 82, 83, and 84 and are slidably coupled to and disposed within the body 16 (e.g., each track 3, 5, is slidably disposed in a track which is fixed within the body 16). It should be apparent that even when all the drawers 80-84 are respectively in a selectively closed position, when the top member 26 is placed in a selectively opened position, the storage compartment 86 of the drawer 84 is accessible. Also, when top member 26 is in a closed position, the cavity 22 may be accessed by opening drawer 84.

Further, as is perhaps best shown in FIGS. 1, 10, 11, and 12 in the most preferred although non-limiting aspect of the invention, upon the internal surface 61 there is deployed a pair of substantially identical and linearly coextensive tracks 91, 93. The tracks 91, 93 are equidistantly spaced, linearly coextensive, and parallel to each other. Each track 91, 93 include equidistantly spaced and substantially identical clips 100. Each clip 100 on track 91 is linearly and horizontally aligned with a unique clip on track 93. Each clip 100 includes a pair of flexible and substantially identical arms 101, 102 which are deployed upon a generally flat and flexible base 103. Each base 103 may be welded or otherwise coupled to a track 91, 93 by a conventional technique and each respective pair of arms 101, 102 of a clip 100 are linearly aligned and substantially identical.

The assembly 12 includes at least one member 105 which has a generally flat bottom surface 107 having a plurality of holes 109 and side portions 110, 111, 112, and 113 which cooperate with the surface 107 to form a cavity 115. Side surface 113 includes a first plurality of generally "cross shaped" openings 120 which are aligned along a first axis 121 and a second plurality of openings 122 which are aligned along a second axis 123. The openings 122 and 120 are each substantially identical and each opening 120 is linearly and horizontally aligned with a unique one of the openings 122. Axis 121 is an axis of symmetry of openings 120 and axis 123 is an axis of symmetry of openings 122.

Each opening 122 and 120 is adapted to allow for receipt and retention of arms 101, 102 and in this manner the openings 120 are each respectively adapted to receive clips 100 of track 91 while openings 122 are each respectively adapted to receive clips 100 of track 93, thereby allowing the member 105 to be placed upon any desired location on the tracks 91, 93 and the placement is removable in that the clips 100, once received by and retained within the openings 120, 122 may be forcibly and selectively dislodged. That is, each opening 120, 122 includes a slit 141 through which arms 101, 102 are placed and then the "placed" arms 101, 102 are made to contact side 113 and the length 119 of the slit 121 is only slightly larger than the length 125 of the substantially identical clips 100, thereby ensuring that once a pair arms 101, 102 are selectively placed through a slit 141, the clip 100 is not readily removable (e.g., it is not likely that the arms 101, 102 will "slide out" of the slit 141 due to the contact with side 113 and due to the fact that the length 119 is only slightly larger than length 125). It should be appreciated that openings 120, 121 are each "complementary" to clips 100 in that openings 120, when receiving the arms 101, 102, allow clips 100 to selectively fasten the member 105 within the assembly 12 in the manner described above. Clips 100 within track 93 are aligned along vertical axis of symmetry 1700 and clips 100 within track 91 are aligned along vertical axis of symmetry 1800.

Figure 11:
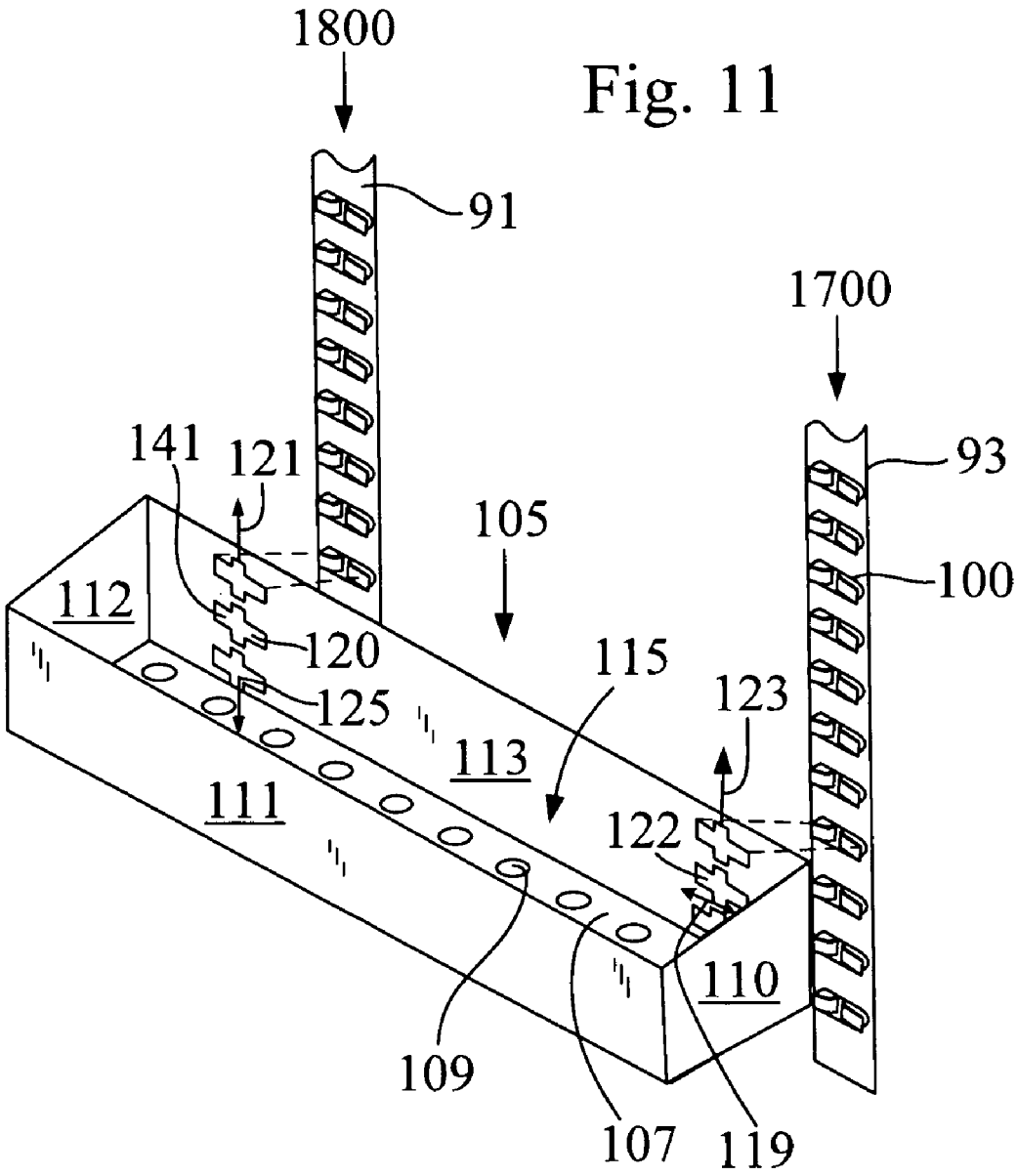
FIG. 11 is an enlarged perspective and unassembled view of a portion of the bottom cabinet which is shown in FIG. 10.
Figure 12:
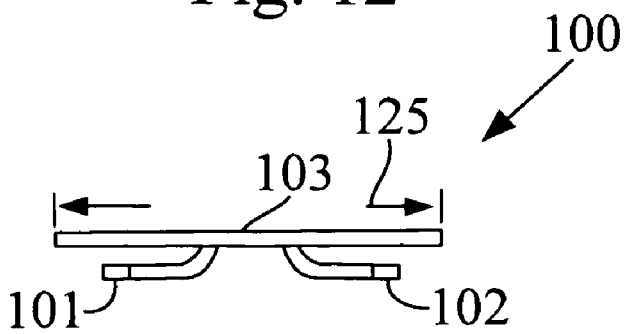
FIG. 12 is a view taken in the direction of view arrow "12".

Importantly, the openings 120, 122 may selectively receive the clips 100 in the manner which is shown in FIG. 11 (with the surface 107 positioned as shown). In this selective configuration, the surface 107 (namely the openings 109) are adapted to receive tools and other implements (such as by way of example and without limitation screw drivers) and to allow the received implements to be easily removed for later use. Alternatively, the surface 107, in the shown position, may be used to contain loose parts and material which are larger than holes 109. In another non-limiting embodiment, the holes 109 are not formed in the surface 107.

In another selectable configuration, as is best shown in FIG. 10, the surface 107 may be made to face downward (in a direction toward the surface 200 upon which the assembly 10 rests). This is accomplished by selectively rotating the member 105, shown in FIG. 11, by about one hundred and eighty degrees in a clockwise manner. In this manner, screw drivers and other implements may be easily placed and removed from the formed holes 109. These clips 100 allow the members 105 to be placed on the tracks 91, 93 in at least two distinct positions (either surface 107 or cavity 115 may face away from surface 200).

As is further shown in FIG. 10, another non-limiting body of a storage tray or member is represented by member 212 (a plurality of members 212 may be utilized) which has a flat base portion 214 which has a side portion 201 which is substantially similar to side 113 (i.e., the portion 201 is generally flat and has openings 120, 122). The member 212 further includes a generally flat ledge portion 215 which orthogonally protrudes from the surface 201 and away from surface 61. The member 212 includes a plurality of equidistantly spaced and substantially similar flexible arms 217 which all wholly reside in the same plane and this plane is parallel to the plane which wholly contains the portion 201. The member 212 also includes a plurality of second flexible members 220 which are substantially similar and equidistantly positioned along edge 221 and are co-planar. The members 220 are orthogonally positioned with respect to portion 212 and protrude away from surface 61. Each arm 217 is positioned above a unique one of the members 220. It should be appreciated that surface 201 is made to selectively receive clips 100 and to therefore be selectively placed upon tracks 91, 93 in the manner which has been previously described.

It should be apparent that the tools and other implements may be selectively placed between adjacent arms 217 and/or between adjacent arms or members 220, thereby further facilitating the storage of a plurality of dissimilar implements and members. It should be apparent that the two track system (i.e., columns 91, 93) allows a user to select which, if any type or number of members 212 and/or 105, they desire to utilize and then to determine the respective amount and placement of the selected members 212, 105. The configurations can be easily changed at any time by simply removing a member 105, 212, putting another member 105, 212 in its place, moving the removed member 105, 212 to a different location, or turning the member 105 to a new position. This feature allows the assembly 12 to be utilized in a wide variety of applications and to meet the needs of ever changing applications which require new and different implements and tools. This "two track" system thus increases the versatility and usefulness of the entire tool box assembly 12.

Figure 22:
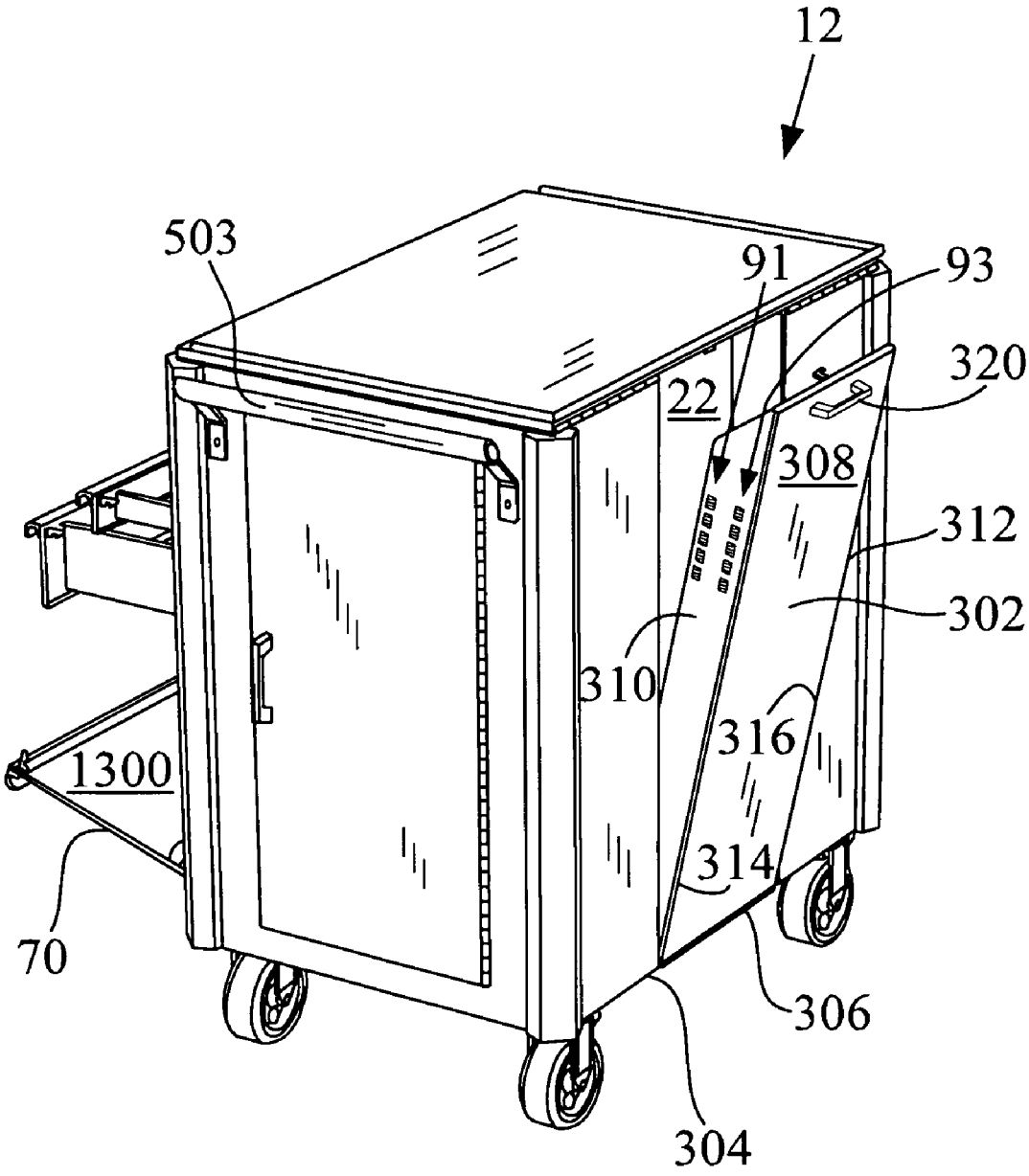
FIG. 22 is a perspective view of the bottom cabinet which is shown in FIG. 10 and further showing the back door being selectively opened.

In another non-limiting embodiment, as is best perhaps shown in FIG. 22, a back door 302 is coupled to the edge 304 by the use of hinge 306 and this door 302 is selectively movable from a first open position (which is shown in FIG. 22) in which access to the internal cavity 22 is allowed to a second closed position in which the door 302 overlays the cavity 22 and prevents access to the cavity 22, through the door passage. In one non-limiting embodiment, the door 302 includes a generally flat back surface 308 and two substantially identical side surfaces 310, 312 which orthogonally extend from and integrally terminate into the back surface 308 along respective edges 314, 316. Each side surface 310, 312 may have two respective tracks 91, 93, thereby allowing members 105 and 212 to be placed upon the surfaces 310, 312. A handle 320 may be deployed upon the surface 308 to facilitate the selective movement of the door 302.

Figure 23:
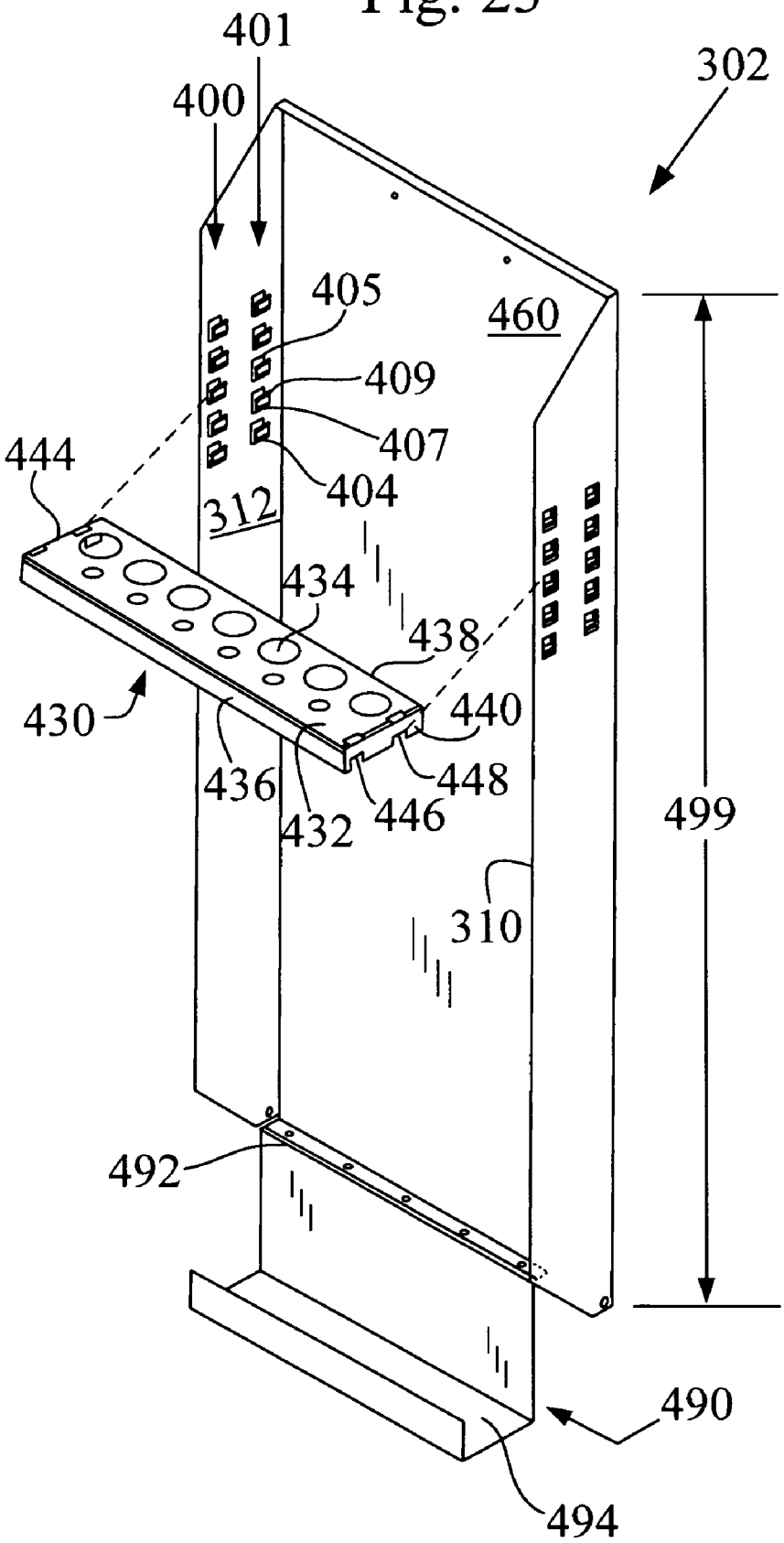
FIG. 23 is an unassembled perspective view of back door portion which is shown in FIG. 22.

Referring now to FIG. 23, there is shown an alternate embodiment of the door 302. In this alternate and non-limiting embodiment, two tracks 400, 401 of substantially identical clips 404 appear on each of the respective side surfaces 310, 312. Each clip 404 includes a generally flat back portion 405 which is attached to one of the surfaces 310, 312 by glue or some other conventional fastening technique, and a front portion 407 which cooperates with the back portion 405 to form a groove 409. The tracks 400, 401 on surface 312 are linearly coextensive and of equal length and are parallel to each other. The tracks 400, 401 on surface 310 are similarly linearly coextensive and of equal length and are parallel to each other. Each clip 404 of track 401 on surface 312 is linearly and horizontally aligned with a unique one of the clips 404 on track 401 on surface 310 and each clip 404 of track 401 on surface 312 is linearly aligned with a unique one of the clips 404 on track 401 on surface 310.

A container 430 may be selectively attached and removed from the back door 302. As shown, container or member 430 includes a generally flat top surface 432 having a plurality of holes 434, opposed and generally flat side surfaces 436, 438 which orthogonally terminate into and project from the surface 432, and opposed short side surfaces 440, 444 which orthogonally terminate into and project from the top surface 432. The surfaces 440, 444 are substantially identical. Moreover, each surface 440, 444 includes a pair of substantially similar notches 446, 448.

In operation, notches 446, 448 from the side portion 440 are made to be respectively and frictionally placed in groove 409 of a clip 404 on track 400 of surface 310 and within a groove 409 of a clip 404 on track 401 of surface 310. Particularly, the respective clips 404 which frictionally receive the notches 446, 448 are linearly and horizontally aligned. Then notches 446, 448 from the side portion 444 are made to be respectively placed in groove 409 of a clip 404 on track 400 of surface 312 and within a groove 409 of a clip 404 on track 401 of surface 312. The grooves 409 which receive the notches 446, 448 on the surface 312 are linearly and horizontally aligned. In this manner, the container 430 is made to be selectively and removably attached to surfaces 310, 312 and the surface 438 abuts the door surface 460. Additional members 430 may be similarly and removably deployed between the surfaces 310, 312 in a substantially similar manner. In this manner, additional and configurable storage may be created within the tool box assembly 12.

Further, in a non-limiting alternative embodiment, a plate 490 may be attached to edge 492 and, as shown perhaps best in FIG. 23, the plate 490 includes a reception trough 494 and this trough 494 is adapted to selectively and removably receive relatively long tools and other implements which may be placed within the holes 434 and increases the overall useable length 499 of the back door 302 and reduces the likelihood that these relatively long implements and tools will protrude from the tool box assembly 12 above the top member 26 and away from surface 200, where they will be unsightly and cause injury.

In yet another non-limiting alternate embodiment of the invention, a handle 503 may be deployed above the door 31 to facilitate the movement of the tool box assembly component 12. It should be realized from the foregoing, that tool box assembly component or portion 12 may function as a stand alone tool box assembly having an easily configurable storage profile and may be easily maneuvered and placed at a desired location.

Figure 2:
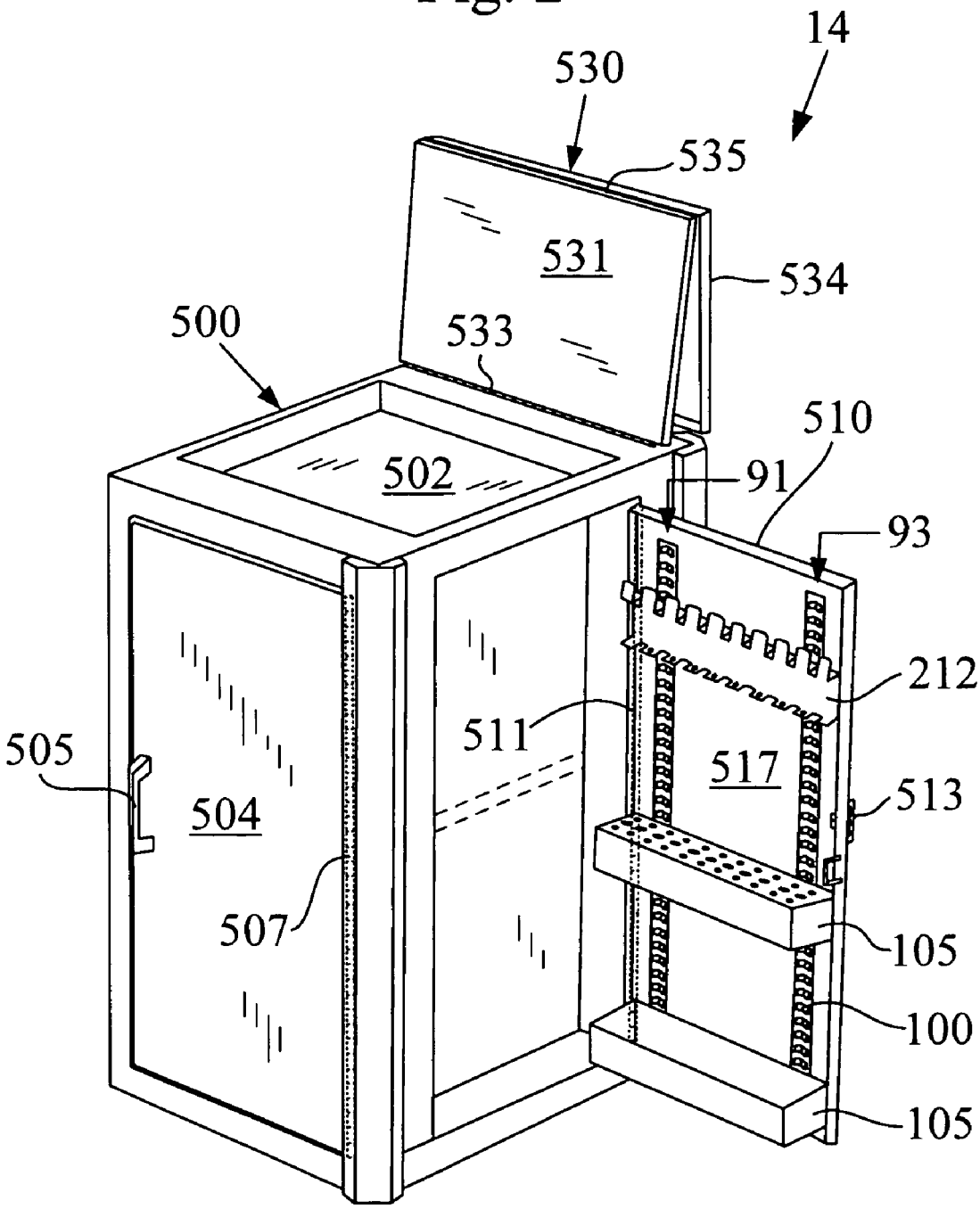
FIG. 2 is a perspective view of the side cabinet assembly which is shown in FIG. 1 in a selective open position.

To further enhance the overall usefulness of the tool box assembly 10, a side tool box or cabinet or storage portion 14 may be selectively attached and detached from the component or assembly 12. Sidebox 14 is an independent storage assembly (i.e., independent of assemblies 12 and 800). In one non-limiting embodiment, as is perhaps best shown in FIGS. 1 and 2, the storage portion 14 includes a generally cubic shaped and hollow body 500 having an internal storage cavity 502. The body 500 further includes a front door 504 which is selectively movable, by the use of handle 505, from a closed position (shown in FIG. 2) in which access to the cavity 502 through the front door passageway 504 is prevented, to an open position (not shown) in which such access is allowed. The door 504 is movably coupled to the body 500 by a hinge member 507, or by any other conventional fastening strategy or technique.

In another non-limiting embodiment, the body 500 may also include a side door 510 which is movably coupled to the body 500 by a hinge member 511 or by any other conventional fastening strategy or technique. The door 510 is selectively movable, by the use of handle 513, from a first closed position in which access to the internal cavity 502 through the passageway of the side door 510 is prevented, to an open position, shown in FIG. 2, in which such access is allowed. Further, the internal door surface 517 may have the two tracks 91, 93 of clips 100 which have been previously explained. These two tracks 91, 93 may receive members or components 105 and/or 212 which have also been previously explained, thereby increasing the amount of storage provided by the assembly 14.

The assembly or component 14, in another non-limiting embodiment of the invention, includes a top member 530 which has a first generally flat portion 531 which is coupled to the body 500 by a hinge member 533, and a second generally flat portion 534 which is coupled to the first generally flat portion 531 by a hinge member 535. In this manner, the top 530 may be made to selectively overlay or cover the top of the cavity 502 by causing the portions 531 and 534 to cooperatively overlay the top of the cavity 502 (portion 534 is made to extend from the member 531) as these members 531, 534 are moved down toward the cavity 502. When it is desired to selectively open or allow top access to the cavity 532, the members or portions 531, 534 are lifted upwards away from the cavity 502, in the manner shown in FIG. 2, and member 534, by the use of hinge 535, folds back against the portion 531, as shown.

Figure 3:
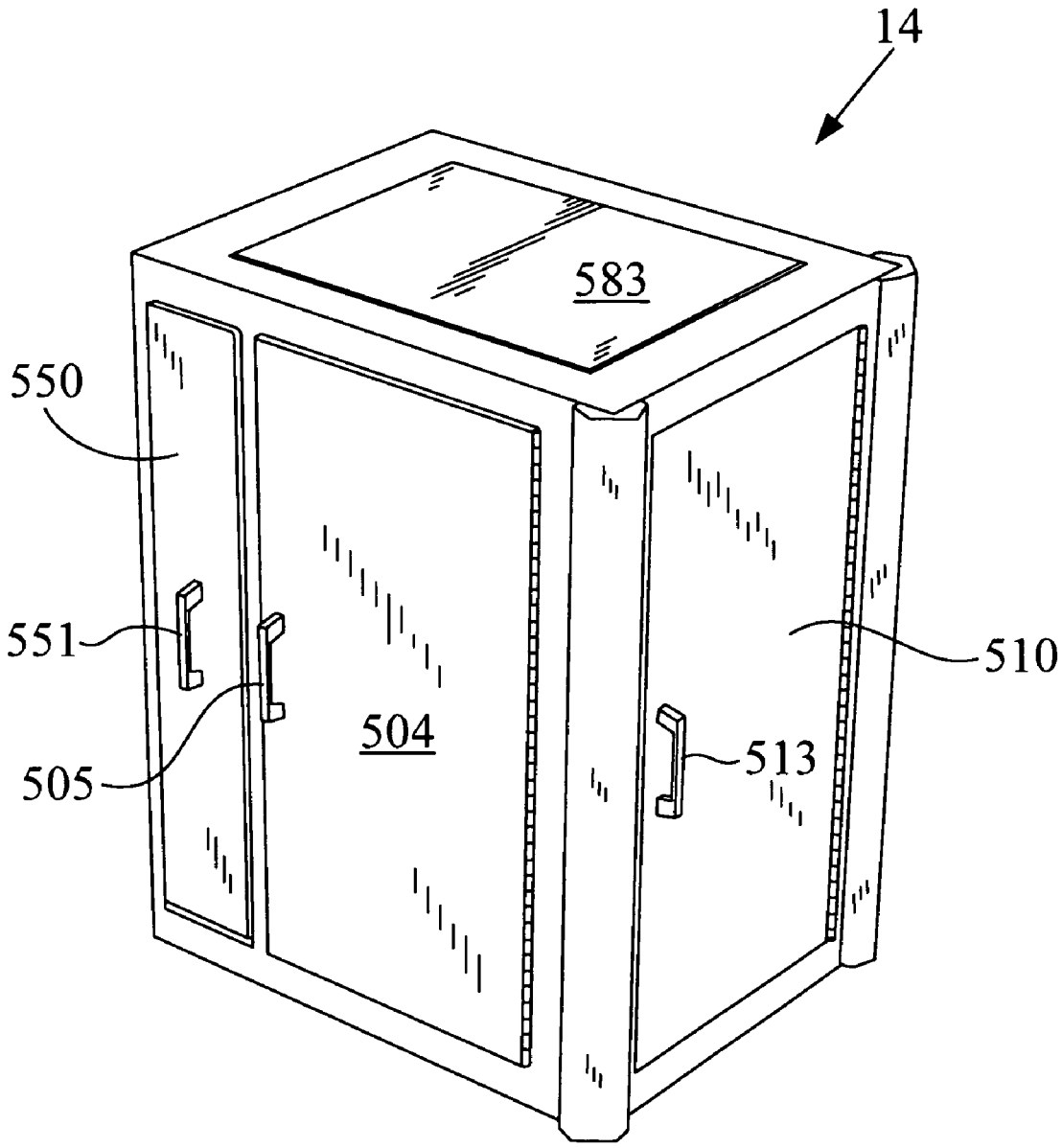
FIG. 3 is perspective view of a side cabinet assembly which is made in accordance with the teachings of an alternate embodiment of the invention.
Figure 4:
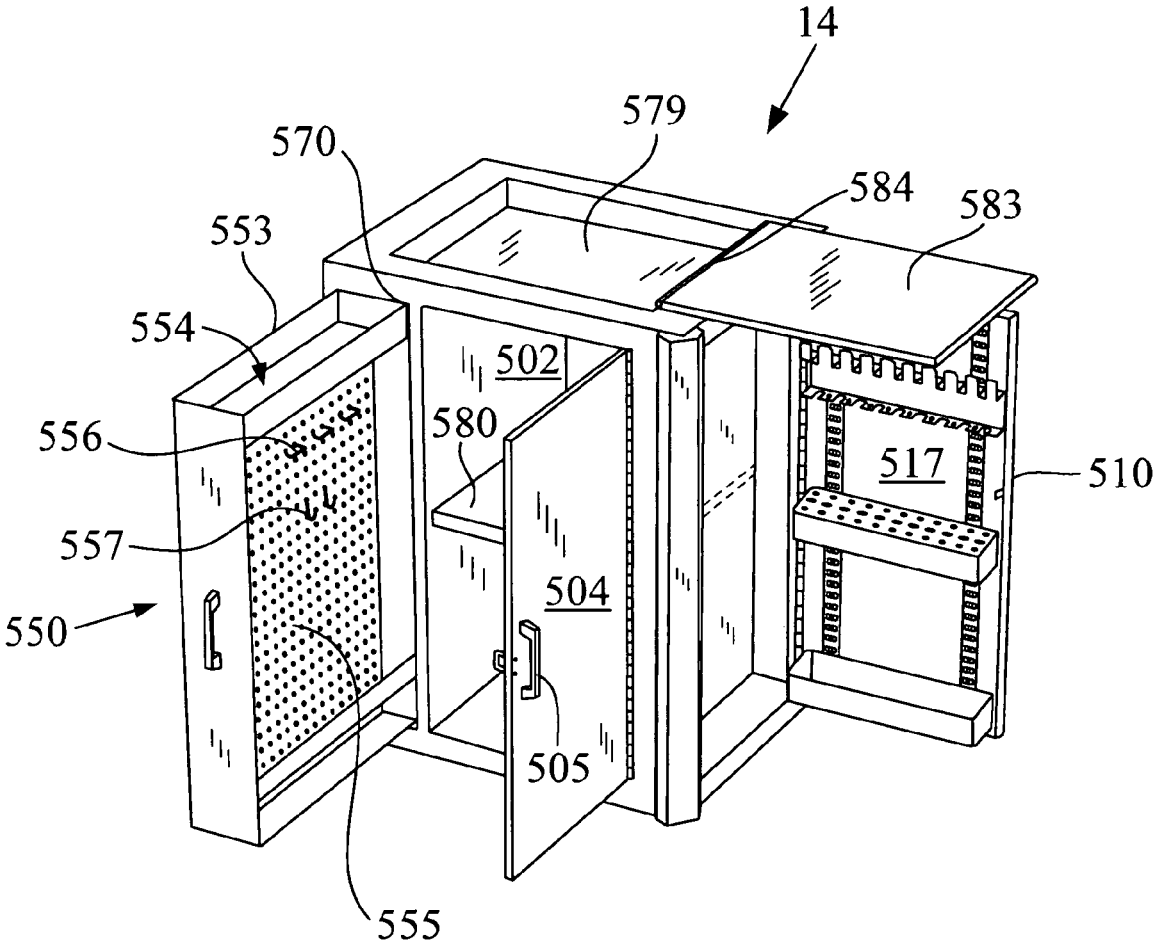
FIG. 4 is a perspective view of the side cabinet which is shown in FIG. 3 in a selective open position.
Figure 6:
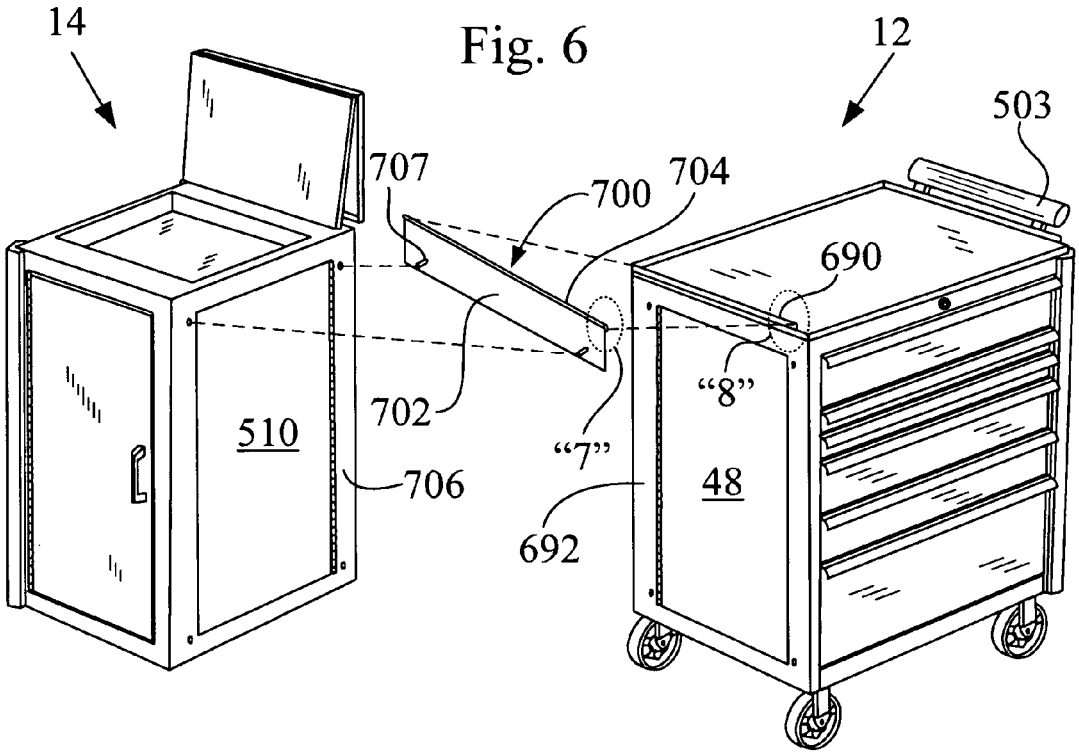
FIG. 6 is a perspective unassembled view of the bottom and side cabinets which are made in accordance with the teachings of an alternate embodiment of the invention.
Figure 7:
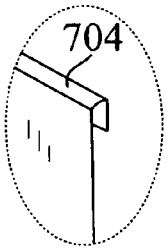
FIG. 7 is a fragmented enlarged view taken around Fragment "7".
Figure 8:
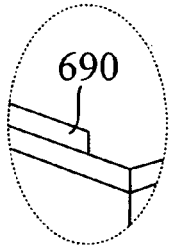
FIG. 8 is a fragmented enlarged view taken around Fragment "8".
Figure 9:
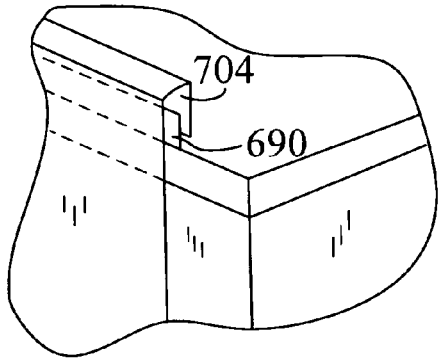
FIG. 9 is a fragmented enlarged portion of the mated side and bottom cabinets.

Referring now to FIGS. 3 and 4, there is shown a second and alternate embodiment of a side cabinet or storage assembly 14. In this non-limiting configuration, a second front door 550 is added to that which has been previously described and a handle 551 is disposed upon the front door 550. The door is movable from a first closed position, which is shown in FIG. 3, to a second open position which is shown in FIG. 4.

The door 550 includes a generally rectangular body 553 having a top trough or storage portion 554 and a pegboard side portion 555 which is adapted to selectively and removably receive "U-shaped" pins or members 556 and/or hook type members 557. Tools and other implements may be selectively hung on and easily removed from these members 556, 557 and the side portion 555 facilitates additional storage. Members 556 may secure a tool, implement, or item against the pegboard 555. Various loose type items may be placed within the trough 554 and later taken away for use in various applications. The door 550 selectively slides within and frictionally fits within the formed pocket 570 within the cavity 502. Moreover, a storage tray 579 may be placed within the body 500 and overlay the cavity 502 and this tray or trough 579 is adapted to store various loose items for later use in a variety of applications. A shelf 580 may also be formed and fixedly reside within the body 500 and within the internal cavity 502 to facilitate the storage of items. Further, a single top member 583 may be utilized and is coupled, by use of hinge 584 to body 500. In this manner, the single top member 583 is selectively movable from a first open position, shown in FIG. 4, in which the cavity 502 or the tray 579 is exposed, to a closed position in which the top member 583 covers the tray 579 or cavity 502.

Referring now to FIG. 5, there is shown a first non-limiting strategy or technique for selectively coupling the storage assembly or member 12 to the storage assembly or member 14. According to this first non-limiting strategy, handle 503 is removed from the body 500 (or not utilized) and door 30 is closed (or not utilized). Then surface 600 of component 12 abuts surface 602 of component 14 and a plurality of bolts, such as bolt 604 are used to selectively secure the two components 12, 14 by being made to pierce surfaces 600 and 602. Other conventional securing techniques and strategies may be utilized. Each bolt 604 may be received by a unique one of the nuts 605 to further strengthen the respective connections.

Referring now to FIGS. 6-9 there is shown an alternate connection strategy for selectively and removably securing the components 12 and 14. In this alternate strategy, a raised edge 690 is formed on surface 692 of the component 12 and the door 48 is not used or closed. The door 510 is closed or not used and a member 700 having a generally flat body 702 and a longitudinal hooked edge 704 is used to connect component or assembly 12 to component or assembly 14.

Particularly, the hooked edge 704 receives the edge 690 and the edges 704 and 690 are linearly coextensive. Then the flat body 702 is coupled to surfaces 692 and 706 by the use of a plurality of bolts 707, thereby securing component or assembly 12 to component or assembly 14. Each bolt 707 may receive a nut or other fasteners. Member 700 allows for a more secure connection between assemblies 12 and 14.

Figure 24:
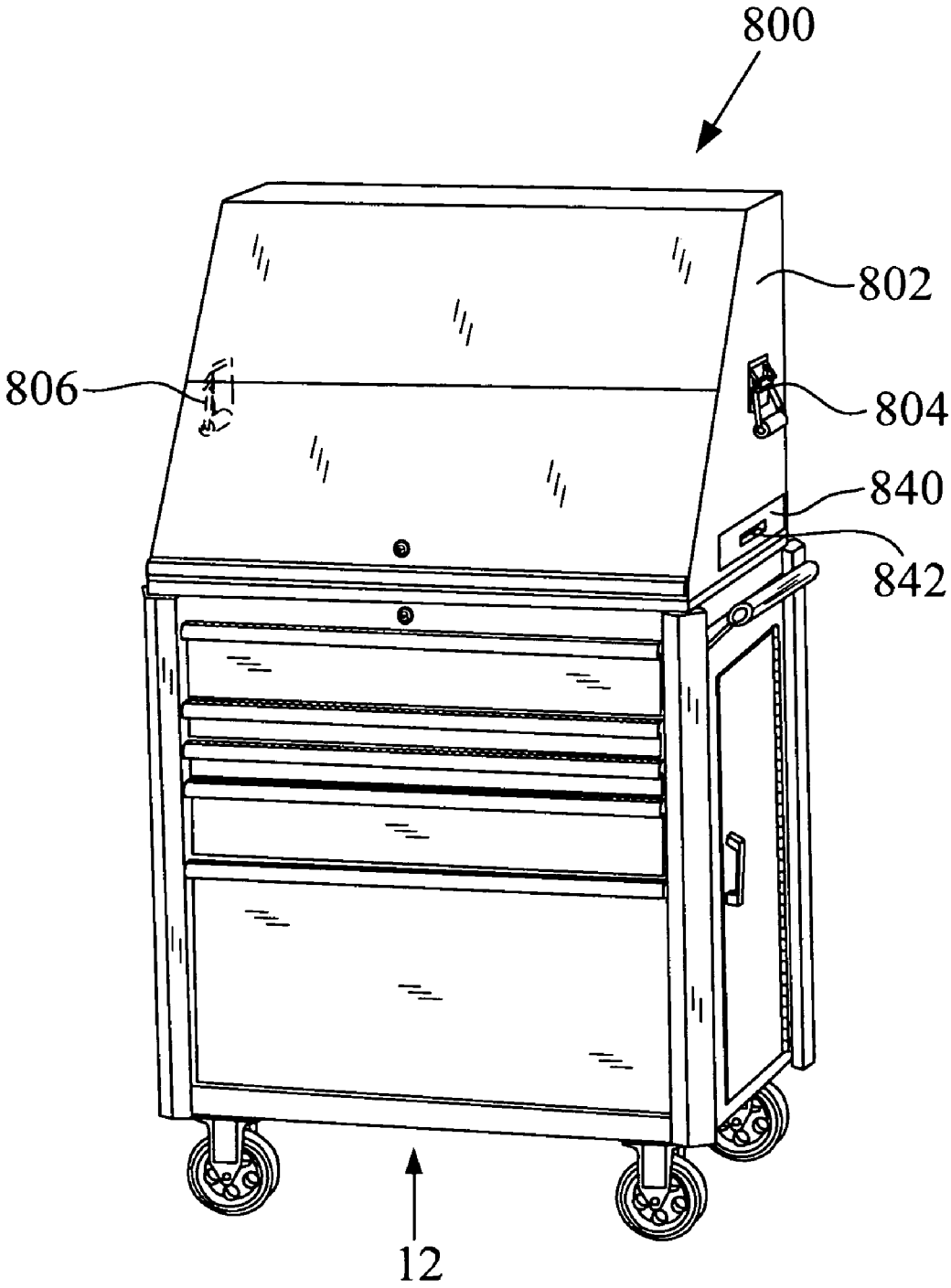
FIG. 24 is a perspective view of a tool box assembly which is made in accordance with the teachings of an alternate and non-limiting embodiment of the inventions.
Figure 25:
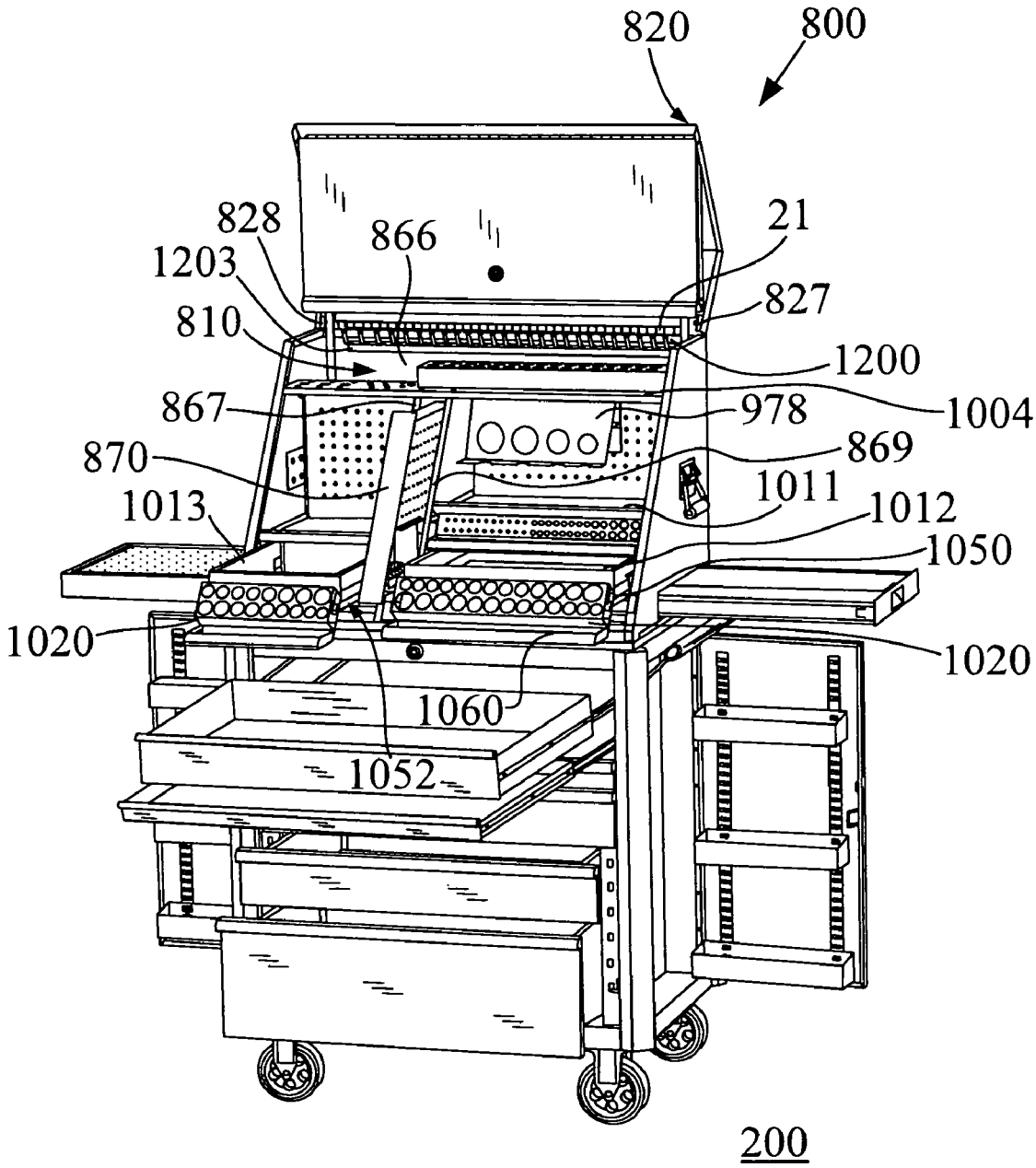
FIG. 25 is a perspective view of the tool box assembly which is shown in FIG. 24 and shown in a selective open position.

Referring now to FIGS. 24 and 25, there is shown a hutch assembly 800 which is made in accordance with the teachings of an alternate embodiment of the invention and shown in selective assembled relationship with the storage compartment or assembly 12. The hutch assembly 800 may or may not be used, depending upon the storage needs of a user and it can also be used on a "stand-alone" basis. As shown perhaps best in FIGS. 24, 25, and 26, the hutch 800 includes a generally hollow body 802 to which opposed and substantially identical handles 804, 806 are attached. The handles 804, 806 are adapted to cooperatively allow the hutch 800 to be selectively lifted off of the assembly 12 and easily transported to a certain location in which a certain application is being accomplished which needs or utilizes the various items contained within the hutch 800. The handles 804, 806 also cooperatively allow the hutch 800 to be easily transported back onto the top of the assembly 12, or to be used without portions 12, 14.

Particularly, the hollow body 802 forms an interior cavity 810 and the interior cavity, as is more fully described below includes several features which greatly enhances the storage capability of the provided storage system. As can be readily seen, a user of the inventions can mix and match the various components 12, 14, 800 to achieve various levels or amounts and types of storage capabilities. For example and without limitation, component 12 may be used on a stand-alone basis or it may be used in combination with hutch 800 and/or component 14. Similarly, hutch 800 may be used on a stand alone basis as can component 14. The combination of hutch 800 and component 14 may also be used together in another non-limiting configuration. Further, the desired or selected storage configuration can be readily altered or changed by adding or removing various components to meet the wide ranging storage needs of a wide variety of users, thereby making storage assembly 10 perhaps best shown in FIG. 1)truly a "mix and match" storage system.

Figures 26, 27:
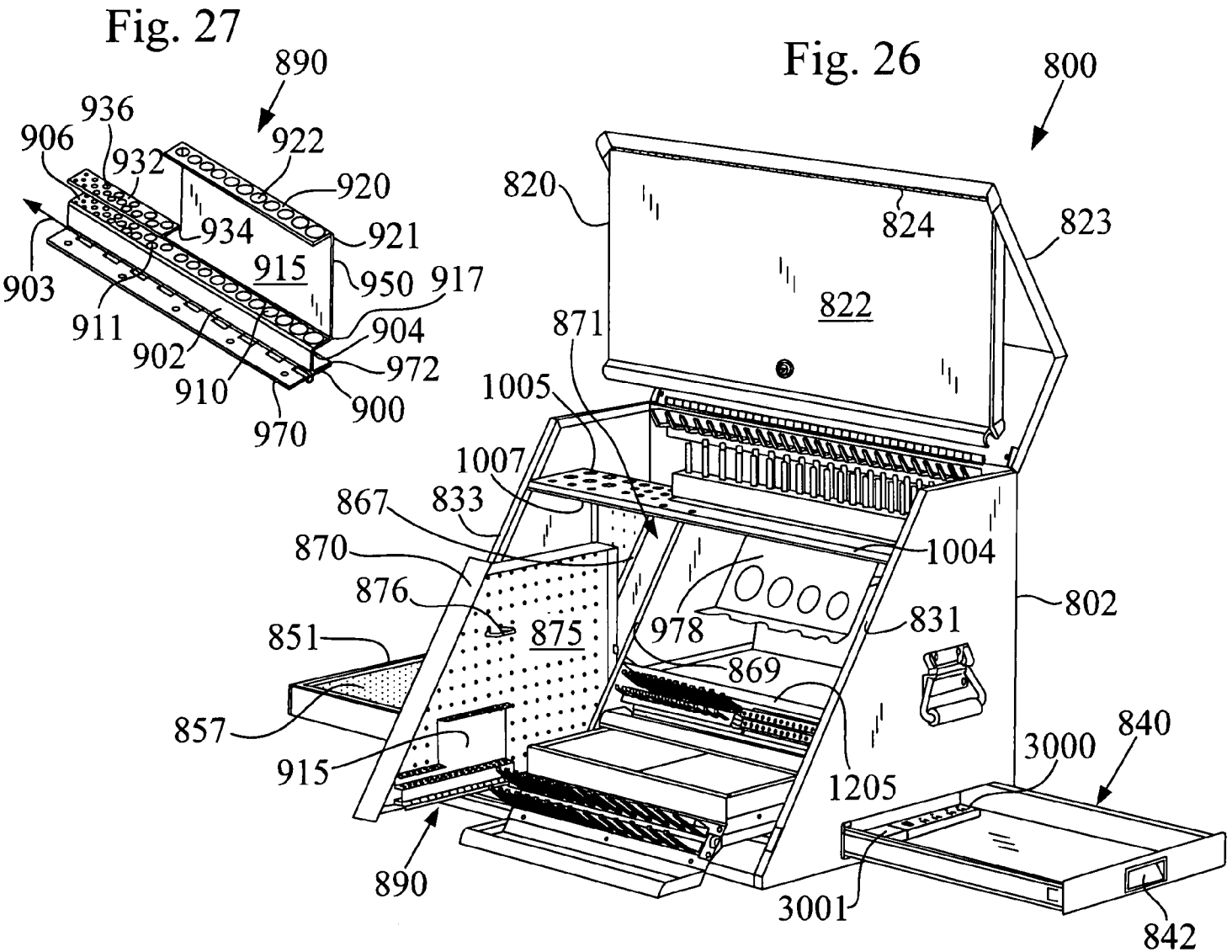
FIG. 26 is a perspective view of the top or hutch portion of the tool box assembly which is made in accordance with the teachings of an alternate and non-limiting embodiment of the invention.
FIG. 27 is a perspective and enlarged view of a portion of the hutch portion which is shown in FIG. 26.

The hutch 800, as is best shown perhaps in FIGS. 26, and 40, includes a movable top 820 having a first generally flat portion 822 which is coupled to portion 823 by the use of a hinge 824. The hinge 824 allows the portion 822 to selectively articulate or rotate in directions toward and away from the portion 823 and the portion 823 may have a crease 9 which forms two separate selectively articulable portions 7, 17 and these portions may allow portion 823 to form a selectable "L" shape. Further, the shaped or angled portion 823 is pivotally coupled by opposed pins 827, 828 to the body 802 and by hinge 21. In this manner, the top member 820 is movable from a first open position (shown in FIG. 25) in which access to the cavity 810 is allowed, to a second closed position (shown in FIG. 24) in which access to the cavity 810 is blocked. This movement is accomplished by moving the top 820 in a downward motion, towards the surface 200. This downward movement causes the portion 822 to pivot about the hinge 824 and to abut side members 831, 833, as does the angled portion 823. To allow access to the cavity 810, the top member 820 is moved upwards away from the surface 200.

The hutch 800 (as is perhaps shown best in FIGS. 25, 26 and 43) includes a first side drawer 840 which selectively emanates from the side member 831 and which is selectively movable from a first closed position in which it is contained within the cavity 810 (see, for example and without limitation FIG. 24), to an open position (see, for example and without limitation FIG. 26) in which the drawer 840 selectively emanates from the member 831. The drawer 840 allows various items to be selectively stored and removed for use, and includes a griping depression 842 which facilitates the described drawer movement. An electrical power strip 3000 may be deployed within the drawer 840 and coupled to a contained and selectively removable, replaceable, and rechargeable battery 3001 or adapted to be selectively coupled to an "outside" or external power outlet. In this manner drawer 840 may contain a laptop or portable computer (not shown) and strip 3000 may allow electrical power to be provided to the computer. Such a power strip 3000 (including a battery 3001) may also be placed anywhere else in assembly 10 and in multiple independent locations.

Figure 43:
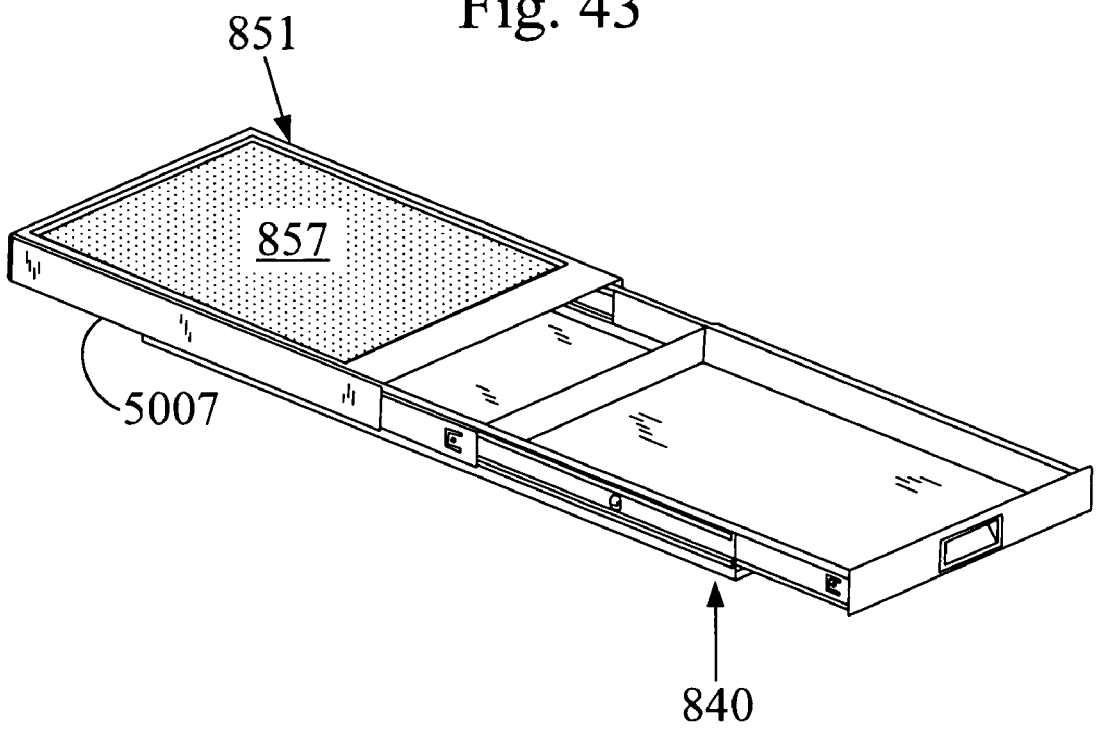
FIG. 43 is a perspective view of a twelfth portion of the top portion which is shown in FIG. 26.

The hutch 800 includes a second side drawer 851, opposed to the first side drawer 840, and this second side drawer 851 contains a peg board 857 upon which various items may be securely and removably placed and stored. In one non-limiting embodiment, the pegboard 857 may be partially "dimpled" or depressed towards the bottom surface 5007 of the drawer 851 in order to prevent items from "sliding" off the board 857. As best shown in FIG. 43, drawer 840 is selectively received by drawer 851 and in the selectively closed position, drawer 840 selectively and removably nestles within drawer 851 and pegboard 857 covers the portions 3000 and 3001. Such nestling allows the drawers 840, 851 to have respective and relatively long lengths then they would if they only abutted within the hutch 800. the drawers 851, 840 thereby cooperatively form a telescoping storing arrangement.

Hutch 800 includes a back wall 866 and in the interior cavity 810 are placed opposed and substantially identical walls 867, 869 which cooperatively define a cavity 871 into which drawer 870 is movably disposed and frictionally fits. The drawer 870 is selectively movable from a first closed position in which the drawer 870 is made to reside within the formed cavity 871, to an open position, shown perhaps best in FIG. 26, in which the drawer 870 is exposed and removed from the cavity 871. In one non-limiting embodiment of the invention, the drawer 870 includes a double sided peg board body 875 which is adapted to receive hooks, such as hook or U shaped member 876 and these members 876 may secure tools and other implements upon the body 875. Attached to the body 875 is bracket or member 890.

As shown best in FIG. 27, bracket 890 includes a flat base portion 900 which terminates into an orthogonally extending portion 902 which lies along the longitudinal axis of symmetry 903 of the base portion 900. Along the edge 904 of the orthogonally extending portion 902 is a generally flat portion 906 which is parallel to and longitudinally coextensive to the flat body portion 900 and which further includes a plurality of openings, such as opening 910 and opening 911. It should be apparent that openings 910, 911 are dissimilar in size and could even be dissimilar in shape. The openings, such as openings 910 and 911 are adapted to selectively and removably receive implements (e.g., such as drill bits) and tools of varying sizes and shapes. Further, the bracket 890 includes another generally flat portion 915 which orthogonally terminates into and projects from the edge 917 and which wholly resides in a plane which is parallel to the plane in which portion 902 wholly resides. Another generally flat portion 920 terminates into and projects from the edge 921 of portion 915 and the portion 920 includes a plurality of openings, such as opening 922. The plane wholly containing portion 920 is parallel to the plane wholly containing body 900. Additionally, the bracket 890 includes yet another generally flat portion 932 which terminates into and orthogonally projects from edge 934 of the portion 915 and the portion 932 includes a plurality of openings, such as opening 932, which may be dissimilar in size and in shape. It should be apparent that openings, such as openings 932 and 920 are adapted to selectively receive tools and other implements for use in various applications. Thus, above flat bottom 900 lie at unique heights above bottom 900, surfaces 920, 932 and 906 which each have openings.

In operation, the back surface 950 of portion 915 is attached to the surface 875 by an adhesive, by a pin or by another conventional fastener technique. Additionally or alternatively, the base 900 may be segmented along longitudinal axis of symmetry 903 and actually comprise two distinct portions segments 970, 972. Segment 970 may be folded (a hinge may couple the segments 970, 972) such that it is selectively parallel to the portion 902 and then attached to the surface 875 by pins, bolts, or other conventional fastener techniques and assemblies. Bracket 890 may be placed anywhere on the surface 875 and multiple brackets may be used.

Figure 28:
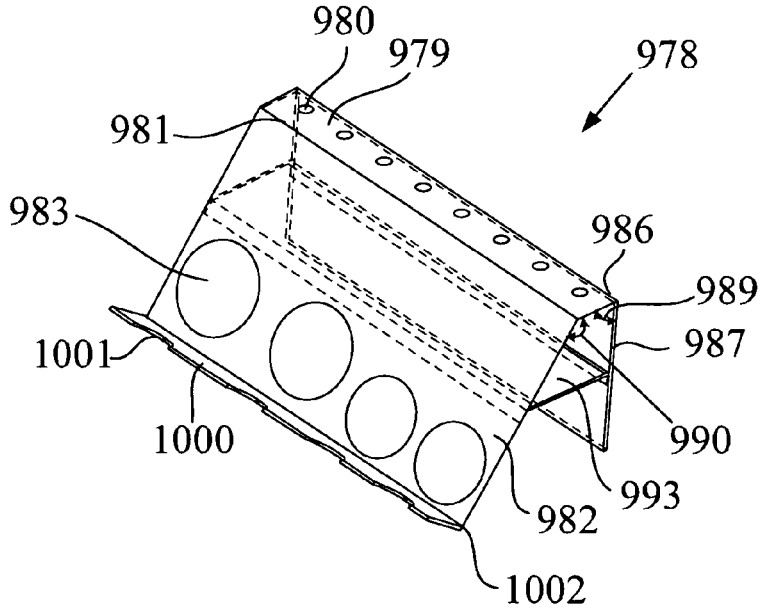
FIG. 28 is a perspective and enlarged view of a second portion of the hutch portion which is shown in FIG. 26.

Hutch 800 further includes, as is perhaps best described in FIGS. 28 and 25, a storage bracket 978 which includes a generally flat top portion 979 having a plurality of substantially identical openings 980. Terminating and angularly projecting from edge 981 is generally flat portion 982 having a plurality of dissimilarly sized holes, such as holes 983. Particularly, each of these dissimilarly sized holes 983 have dissimilar diameters.

Terminating and angularly projecting from edge 986 is generally flat portion 987 which forms an acute angle 989 with the edge 986. Portion 982 forms an obtuse angle 990 with edge 981. A reinforcing member 993 couples portion 987 to portion 982. A ledge member 1000, having a plurality of substantially identical notches 1001, angularly projects from the edge 1002 of the portion 982 and the center of each notch 1001 is aligned with the center of a unique one of the holes 983.

In operation, the top portion 979 is attached to a plate 1004 which spans the interior cavity 810 of the hutch 800 and is attached to the end portions 831, 833 and includes dissimilarly sized holes, such as hole 1005, for storage. Particularly, the surface 979 is made to be attached to the underside surface 1007 of the plate 1004 and bolts or other fasteners are made to traverse openings 980 and attach to the surface 1007, thereby attaching bracket 978 to plate 1004. In this manner, tools and other implements may be easily and removably placed within the holes 983 and supported in such placement by the notches 1001.

Hutch 800 further includes three drawers 1011, 1012, and 1013 which are each movably disposed (by the use of respective and opposed tracks (not shown)) within the internal cavity 810 and which are respectively and selectively movable from a respective first position in which the respective drawer 1011, 1012, and 1013 are wholly contained within the internal cavity 810, to a respective and selectable and second extended position in which the respective drawers 1011, 1012, and 1013 are extended out of the internal cavity 810 in a direction opposite or away from surface 802. Each of the drawers 1011, 1012, and 1013 may and does provide respective storage space in which tools, implements and/or other items may be deposited for use in a variety of applications.

Figure 29:
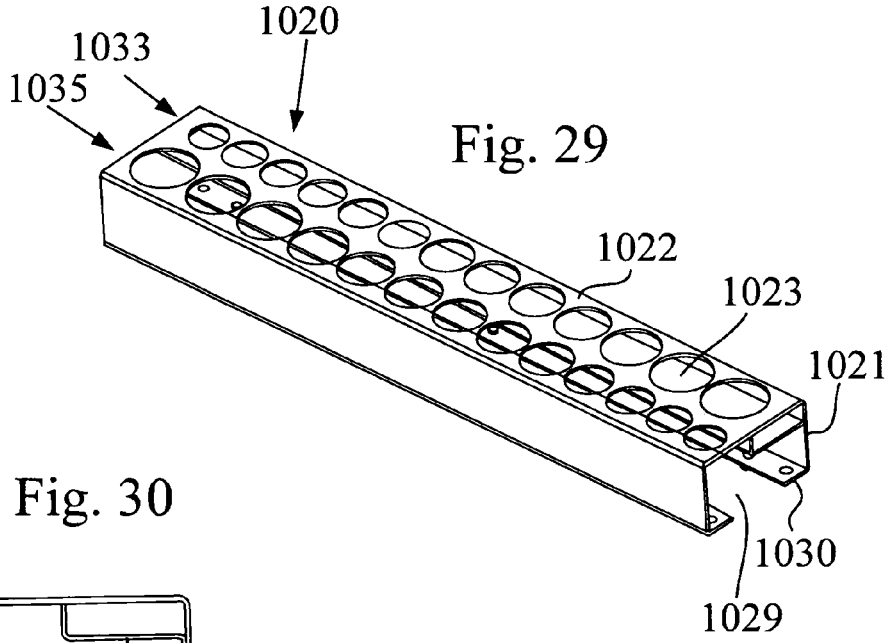
FIG. 29 is a perspective and enlarged view of a third portion of the hutch portion which is shown in FIG. 26.
Figure 30:
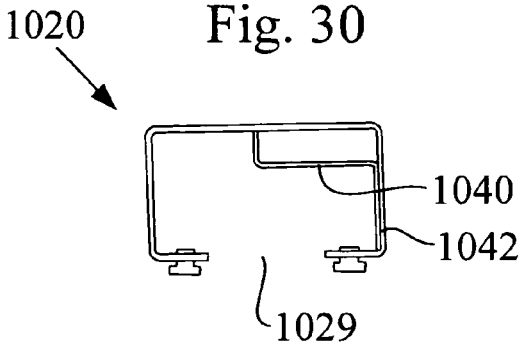
FIG. 30 is a side view of the third portion which is shown in FIG. 29.

In one non-limiting and alternate embodiment of the inventions, a bracket 1020 (see, for example FIGS. 29, 30 and 25) is attached to and angularly deployed upon the front of each of the drawers 1011, 1012, and 1013. The bracket 1020 has body 1021 having a "U shaped" cross sectional area with a top surface 1022 having a plurality of dissimilarly sized holes, such as hole 1023. The plurality of holes, such as hole 1023 may even be dissimilarly shaped. A groove 1029 is formed in the bottom surface 1030 and the back row of holes 1033, such as hole 1023, have a depth which is less than the depth of the front row of holes 1035 due to the placement or formation of member 1040 which is linearly coextensive to the length of the surface 1022 and which is parallel to the surfaces 1022 and 1030. The member 1040 is coupled to the top surface 1022 and to the side surface 1042 and resides below the back row of holes 1033 but above the formed groove 1029. The amount and type of holes 1023 may vary as desired.

In operation, (see, for example, FIG. 37), the bottom surface 1030 of a bracket 1020 is attached to a planar member 1050 (by a rivet, bolt, or other fastener) and the member 1050 is coupled to and forms an acute angle 1052 with the bottom surface 6000 of a drawer 1011, 1012, and 1013. Member 1050 may form as integral part of each drawer 1011, 1012, 1013. The front row 1035 and the back row 1033 of holes are adapted to selectively, cooperatively, and removably receive tools and implements of various sizes and shapes. The angled attachment of a bracket 1020 to a drawer 1011, 1012, and 1013 makes it relatively easy for a user to selectively place and remove an implement from the bracket 1020. Such attachment of a bracket 1020 to drawers 1011, 1012 and 1013 may be done by welding or by any other desired fastening strategy. Further, in an alternate and non-limiting embodiment of the invention, a tray 1060 is attached to and protrudes from each bracket 1050 and provides yet more storage space for a variety of loose items and implements and tools. Thus, in one non-limiting embodiment, each drawer 1011, 1012 and 1013 has such a member 1050 and upon each respective member 1050 resides a bracket 1020 and tray 1060 is respectively attached to each such bracket 1050. Tray 1060 may be integrally formed with a bracket 1050. The front of each drawer 1011, 1012, 1013 includes a movable bracket 1050 with a trough portion 1060, in one non-limiting embodiment.

More particularly, as is perhaps best shown in FIGS. 37 and 38 and in a non-limiting and alternate embodiment of the invention, each drawer, such as drawer 1011, has an angled portion 1050 which is integrally formed with a tray or trough portion 1060 and the bracket 1020 or a pin assembly 1100 (which will be described later) may be respectively and selectively attached to a planar or generally flat member 1101. It is this member 1101 which is then selectively coupled to the member 1050.

The flat member 1101 has four shoulder type rivets (i.e., rivets 1102, 1103, 1105, and 1107) which respectively and operatively reside at a respectively unique corner. Member 1050, in this non-limiting embodiment, includes substantially identical "tear drop shaped" slots 1109, 1110, 1111, and 1113 which are each respectively located at a respective unique corner. Each tear drop shaped slot 1109, 1110, 1111, and 1113 has a large opening portion 1120 and a narrow opening portion 1121. The narrow portions 1121 of each slot 1109, 1110, 1111, and 1113 each point to side 833. In the most preferred although non-limiting embodiment of the invention, the portion 1050 is substantially similar in size and shape to the portion 1101, although portion 1050 is slightly longer along length 1104. Thus, when portion 1101 overlays and fully covers portion 1050, each rivet 1102, 1103, 1105, and 1107 easily and respectively resides within a unique one of the large open portions 1120. Once the rivets 1102, 1103, 1105, and 1107 selectively and respectively reside within a unique one of the open portions 1120, the portion 1101 is moved in the direction of side 833, thereby causing each captured rivet 1102, 1103, 1105, and 1107 to be moved to a unique one of the small openings 1121 and preventing the portion 1101 to be easily dislodged from its assembled position on the portion 1050. One advantage of this non-limiting embodiment is that various dissimilar brackets or pin assemblies or any other desired assembly may be formed or placed on the top surface 1901 of portion 1101 and selectively and removably used on any one of the drawers 1011, 1012, and 1013, thereby making the storage hutch 800 very malleable to meet ever changing needs.

Further, in a non-limiting alternate embodiment of the invention, the portion 1050 is pivotally coupled to the drawer surface 1151, by the use of connecting pins 1170, 1171, such that the portion 1050 is movable from a first position in which the trough 1060 is extended away from the surface 1151 to a second position in which the trough 1060 moves in the arcuate direction 1155 toward the interior 1157 of the drawer, such that the trough 1060 resides within the interior 1157. Such movement can be done manually.

Figure 39:
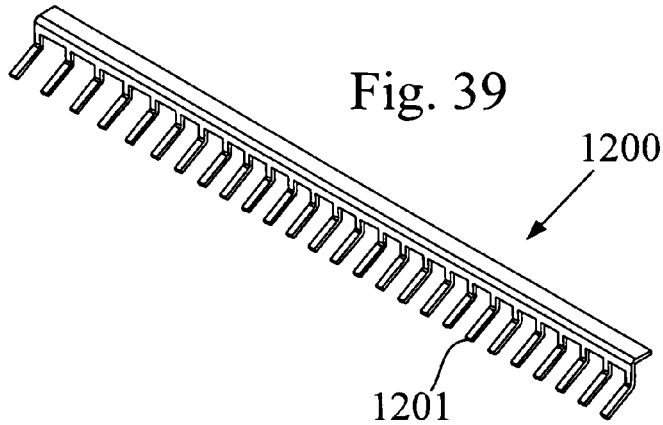
FIG. 39 is a perspective and unassembled view of an eighth portion of the hutch portion which is shown in FIG. 26.

As shown best in FIGS. 25 and 39, a single pin assembly 1200 may be utilized on the top surface 1901 of the portion 1101 and the assembly 1200 includes a plurality of identical pins 1201 which are adapted to selectively receive hollow parts and other implements. Such a pin assembly 1200 may also be deployed on the top shelf 1203 of the hutch 800.

Figure 33:
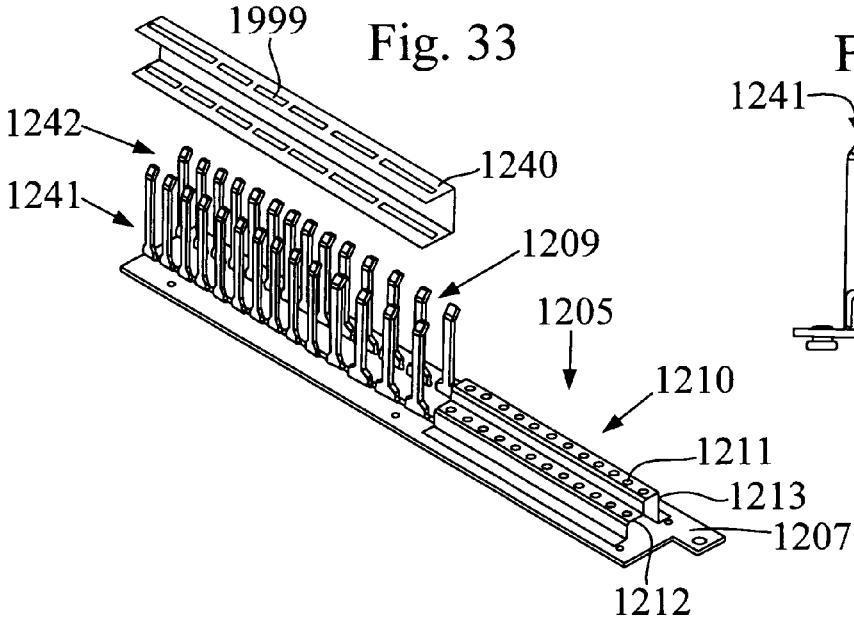
FIG. 33 is a perspective and enlarged and unassembled view of a fifth portion of the hutch portion which is shown in FIG. 26.
Figure 34:
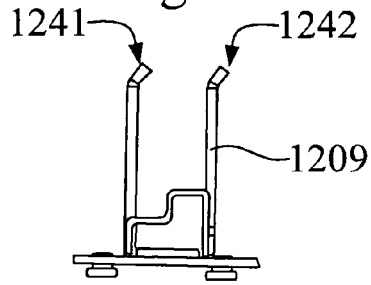
FIG. 34 is a side view of the fifth portion which is shown in FIG. 33.

In yet another non-limiting embodiment, an assembly 1205 may be deployed on the top surface 1901 of the portion 1050, as is perhaps best shown in FIGS. 26, 33, and 34. This assembly 1205 includes a flat bottom surface 1207 upon which a plurality of substantially identical pins 1209 are deployed and emanate from, and second portion 1210 comprising a dual stepped surface having a plurality of substantially identical holes 1211 on each step 1212, 1213. The pins 1209 may receive hollow implements or other tools or items and the holes 1211 may receive elongated type implements, tools, and/or other items. A "C-Shaped" guide 1240 may be received by a single row 1241, 1242 of pins and is effective to reduce the length of a row of pins 1241, 1242 which is received by an item, tool and implement. Such a guide 1240 makes it easier for a relatively small or short type implement, tool, or item to be placed on the row of pins 1241, 1242 which guide 1240 receives (e.g., the row of pins 1241, 1242 which receive the guide to 1240 do so through openings 1999). That is, the pins of the row 1241, 1242 traverse openings 1999 and the guide 1240 receives the pins 1241, 1242 before an implement or tool is received. So, if a relative small or short implement, tool, or item is received by a long pin there exists the requirement for a user to place their hands or fingers within the two rows of pins 1241, 1242 which might cause injury and these long rows of pins 1241, 1242 might even make it appear that the small or short implement is missing, since these rows 1241, 1242 might appear to hide the short or small implement, tool or item. The guide abuts the received tools and implements (since the guide is first positioned on the pins) and raises the received tool, implement, and/or item closer to the user.

Figure 35:
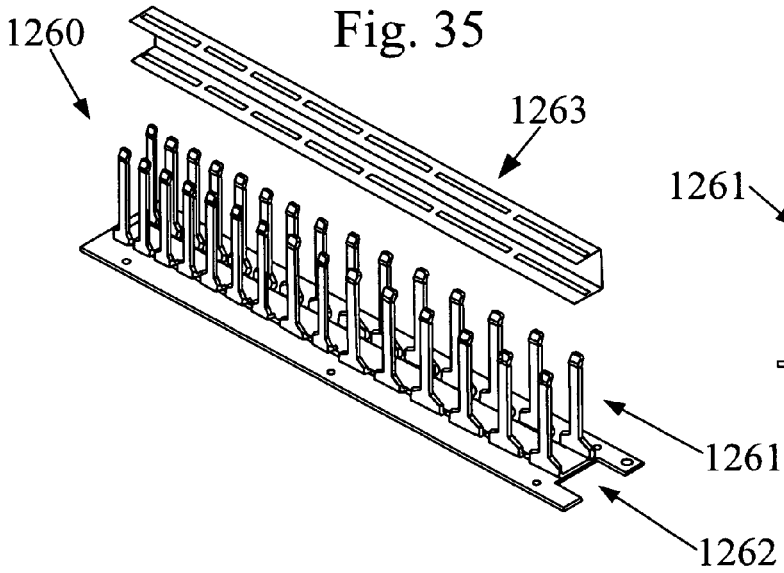
FIG. 35 is a perspective and enlarged and unassembled view of a sixth portion of the hutch portion which is shown in FIG. 26.
Figure 36:
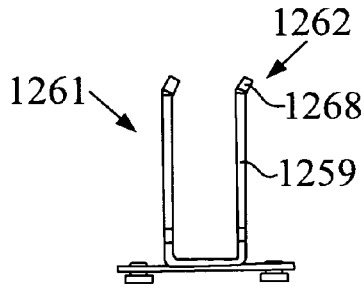
FIG. 36 is a side view of the sixth portion which is shown in FIG. 35.

In yet another non-limiting embodiment of the invention, a full pin assembly 1260 might be selectively attached to the top surface 1901 of the portion 1050 (perhaps best shown best in FIGS. 35, 36). This assembly 1260 includes a first row 1261 and a second row 1262 of pins 1259 and a guide 1263 might be selectively deployed on a row 1261, 1262. In this non-limiting embodiment, each pin 1259 has a bent top 1268 which reduces the likelihood of a received item, implement, or tool to be easily removed off a pin 1259.

Figure 31:
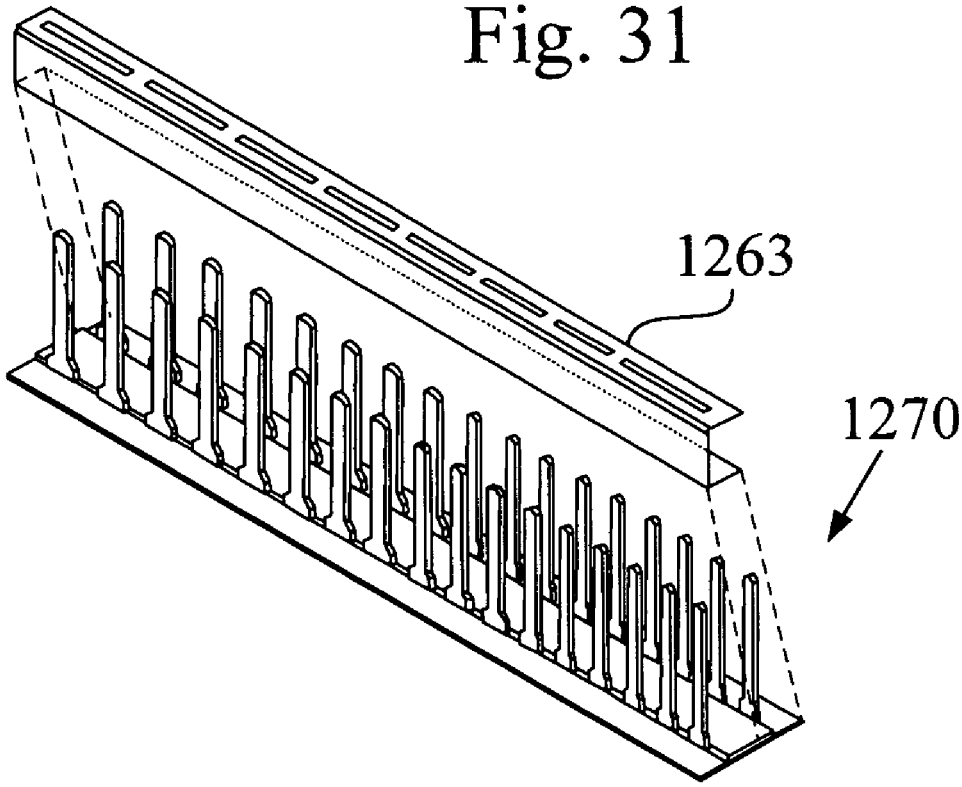
FIG. 31 is a perspective and enlarged view of a fourth portion of the hutch portion which is shown in FIG. 26.
Figure 32:
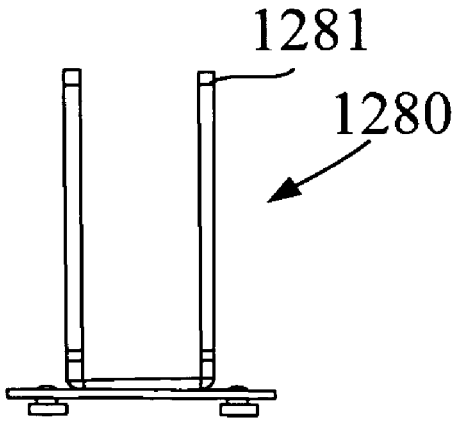
FIG. 32 is a side view of the fourth portion which is shown in FIG. 31.

In yet another non-limiting embodiment of the invention, a full pin assembly 1270 may be utilized on the portion 1050 (as is perhaps best shown in FIGS. 31, 32). This assembly 1270 is substantially similar to assembly 1260, except that the plurality of substantially identical pins 1280 each have a linearly body and a non-bent top 1281. Assembly 1270 may even be operatively deployed on the shelf 1005.

In yet another alternate and non-limiting embodiment of the invention, the storage assembly or storage component 12 includes a centralized locking system, which will now be explained in greater detail.

Figures 14, 15, 16, 17, 18:
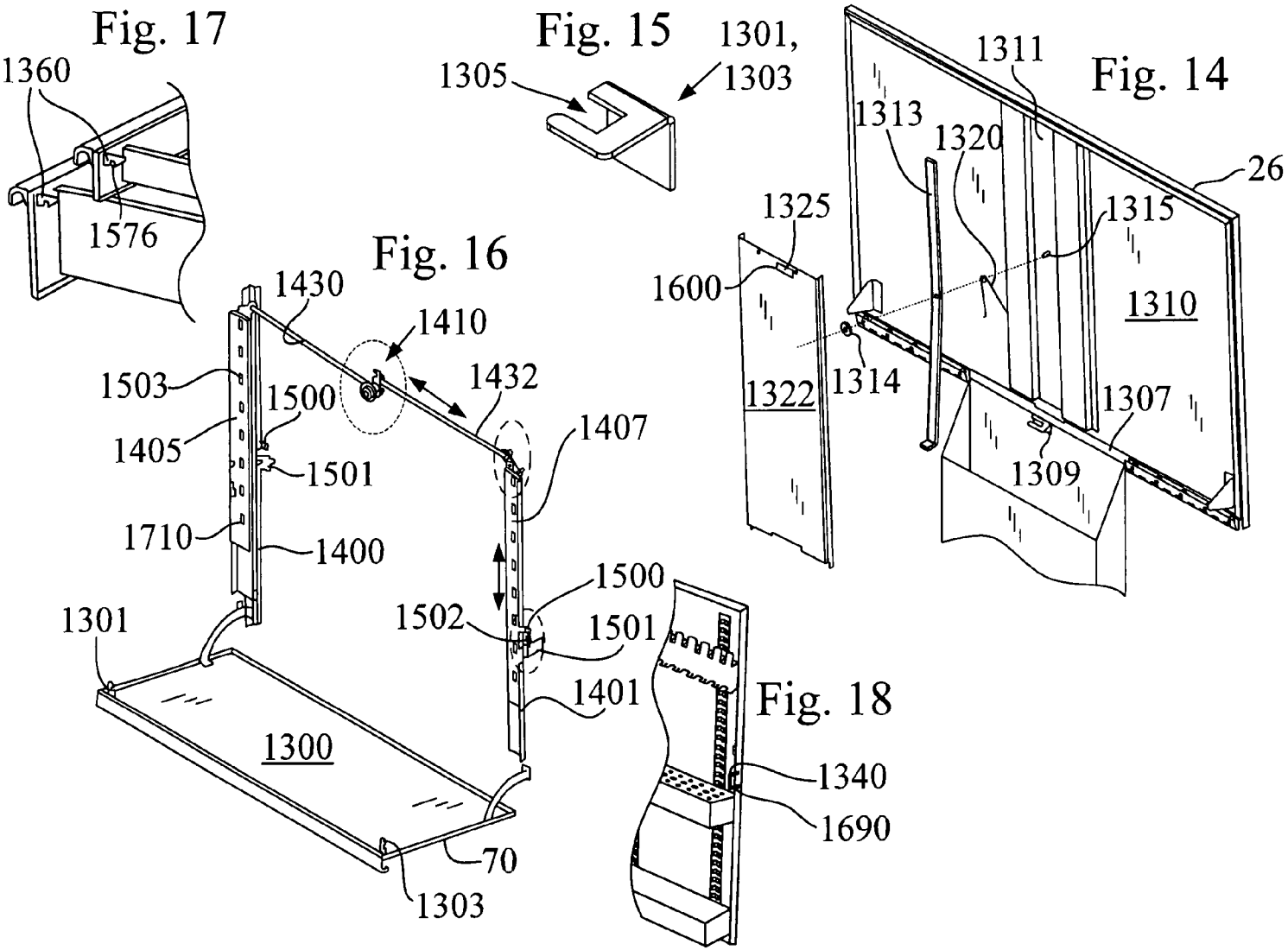
FIG. 14 is an unassembled perspective view of a first portion of a locking assembly which may be selectively and operatively deployed within the bottom cabinet portion which is shown in FIG. 13.
FIG. 15 is an unassembled perspective view of a second portion of a locking assembly which may be selectively and operatively deployed within the bottom cabinet portion which is shown in FIG. 13.
FIG. 16 is an unassembled perspective view of a third portion of a locking assembly which may be selectively and operatively deployed within the bottom cabinet portion which is shown in FIG. 13.
FIG. 17 is an unassembled and perspective view of a fourth portion of a locking assembly which may be selectively and operatively deployed within the bottom cabinet portion which is shown in FIG. 13.
FIG. 18 is an unassembled and perspective view of a fifth portion of a locking assembly which may be selectively and operatively deployed within the bottom cabinet portion which is shown in FIG. 13.

In this non-limiting embodiment, the back surface 1300 of the drawer 70 includes two substantially identical corner brackets 1301, 1303 (see, for example FIGS. 15 and 16). Each bracket 1301, 1303 has a slot 1305 and the inside lip 1307 of top 26 includes another bracket 1309 which is substantially similar to brackets 1301, 1305. Further, the top 26 has an inside surface 1310, including a groove 1311. A bent rod 1313 operatively resides within the groove 1311 and is coupled to surface 1310 by the use of pin 1315 and a nut 1314. Between the nut 1315 and the rod 1313 resides a biasing spring 1320 (which is coupled to surface 1310 by welding, glue, or some other known technique) and which engages and biases the rod 1313 in a direction away from the surface 1310. A plate 1322 is attached to the inside surface 1310, by a conventional fastening strategy, and covers most of the rod 1313 and the groove 1311. The panel 1322 includes a slot 1325.

Figure 13:
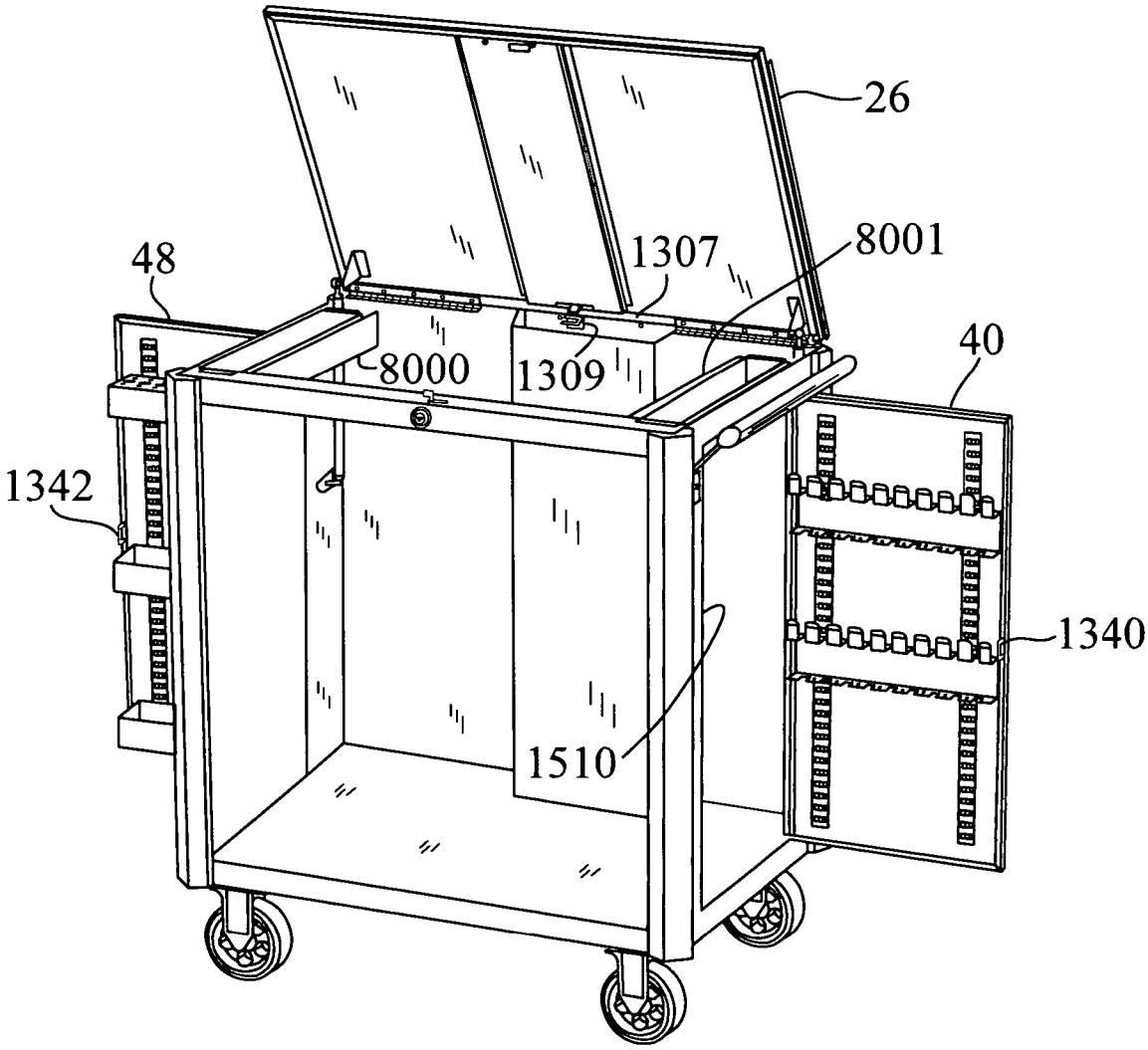
FIG. 13 is a view similar to that which is shown in FIG. 10 but with the drawers removed.

Further, as is perhaps best shown in FIGS. 13 and 18, each side door 40, 48 respectively includes substantially identical side brackets 1340, 1342 and each drawer 80, 81, 82, 83, and 84 have respective and opposed brackets 1360 (partially shown in FIG. 17).T*hat* is, more specifically, each drawer 81-84 respectively includes a respective bracket 1360 on the respective corner nearest the side door 40 and on the respective corner nearest the side door 48.

In this alternate and non-limiting embodiment, there is disposed within the component 12 two stationary guides or channels 1400, 1401, which are linearly coextensive, substantially similar, and have a respective longitudinal axis of symmetry which is perpendicular to surface 200. Each channel 1400, 1401 may be respectively welded to members 8000, 8001 of body 12 and may even protrude through the cavity 22 and be attached to the bottom surface 18. Further, a member 1405 is movably disposed within channel 1400 and a member 1407 is movably disposed within channel 1401. The channels 1400 and 1401 respectively constrain the members 1405 and 1407 to generally and only reciprocally move in directions which are perpendicular to the surface 200.

The component includes a selectively rotatable lock member 1410 having a key slot 1411 and, as should be understood, upon reception of a proper key within the slot, the member 1410 may be selectively rotated in a counterclockwise or clockwise direction. The lock member 1410 is coupled to members 1430 and 1432 and the member 1430 is coupled to the guide 1405 while member 1432 is coupled to guide 1407.

Figure 19:
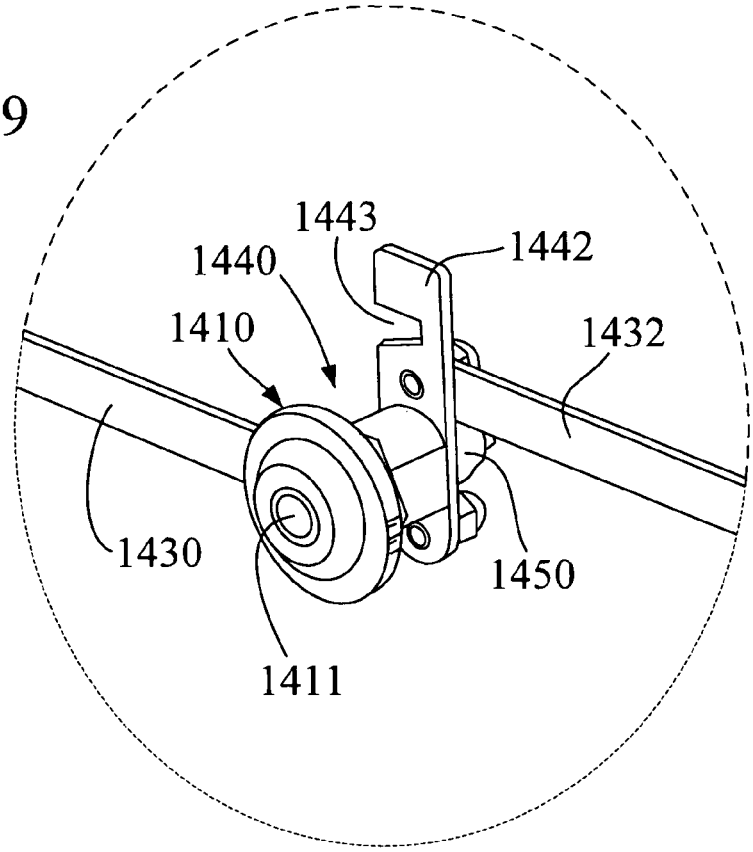
FIG. 19 is an unassembled and perspective view a sixth portion of a locking assembly which may be selectively and operatively deployed within the bottom cabinet portion which is shown in FIG. 13.
Figure 20:
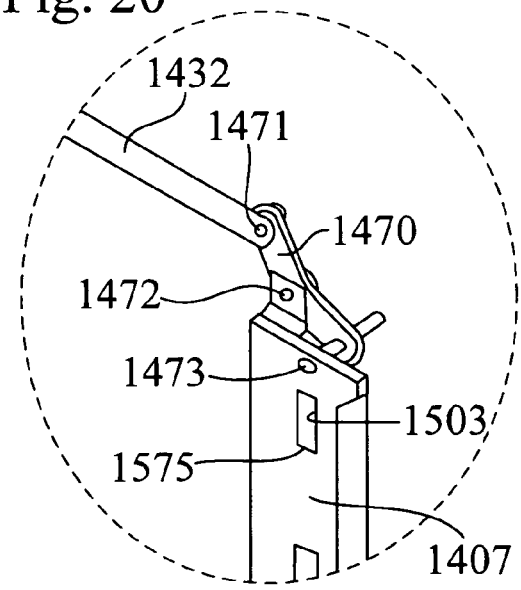
FIG. 20 is an unassembled and perspective view of a seventh portion of a locking assembly which may be selectively and operatively deployed within the bottom cabinet portion which is shown in FIG. 13.

Particularly, the coupling of lock member 1410 to member 1432 is accomplished by an assembly 1440 (see, for example, FIGS. 16 and 19) which includes a generally flat member 1442 having a slot 1443. The flat member 1442 is coupled to a cam assembly 1450 which turns in the direction of the turn of the lock member 1410 and which imparts the received rotation onto member 1432. Further, member 1432 is coupled to the guide member 1407 (see, for example, FIGS. 16 and 20) by arcuate shaped member 1470. The member 1470 is coupled to member 1432 by pin 1471 and is coupled to guide member 1407 by pins 1472 and 1473. The member 1470 selectively pivots at these pins 1471, 1472, and 1473 in response to the selectively rotation of the lock member 1410, such lock member rotation begin transferred to the member 1470 by the cooperative coupling arrangement of member 1432 and the cam assembly 1450. Member 1430 may be similarly coupled, in an alternative embodiment, to guide member 1405.

Figure 21:
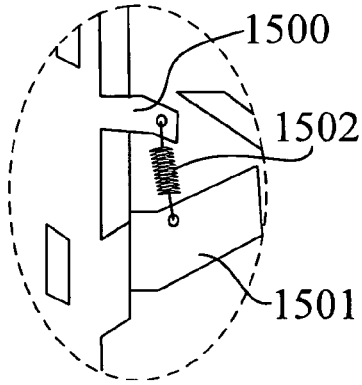
FIG. 21 is an unassembled and perspective view an eighth portion of a locking assembly which may be selectively and operatively deployed within the bottom cabinet portion which is shown in FIG. 13.

Further, as is perhaps shown best in FIGS. 21 and 16, guide members 1405 and 1407 each have respective and protruding flanges 1500, 1501 and each flange 1501 is respectively coupled to a biasing spring 1502 which couples a flange 1500 to a flange 1501 and each flange 1501 is respectively and stationary disposed within a unique one of the brackets 1340, 1342. The biasing spring 1502 normally biases the flange member 1501 upward, in a direction opposite off and away from edge 1690. Each member 1405, 1407 respectively includes a plurality of substantially similar and equidistantly placed slots 1503. The operation of the spring 1502 and the other locking components will now be described.

In operation, each bracket 1360 of each drawer 80-84 resides within a unique one of the openings 1503. The brackets 1360 closest to the door 40 reside within openings 1503 which are positioned on the member 1407 while those closes to the door 48 reside within openings 1503 which are formed within member 1405. When the assembly 12 is unlocked, the brackets 1360 may easily be moved in and out of the respective openings 1503 that they reside within. When the lock member 1410 is turned counter-clockwise, then the members 1405, 1407 are raised (moved in a direction opposite to surface 200) and this causes the respective edges 1575 formed at the bottom of each respective opening 1503 to catch or engage or be received in the slot 1576 of the respective bracket 1360 that the openings 1503 respectively contain or receive and such selective engagement prevents the drawers 80, 81, 82, 83, and 84 from being moved outwardly or opened.

Further, in the selective open position, the portion 1442 resides within the slot 1325 without engagement. In this manner, the top 26 is allowed to be selectively opened and closed. When the lock member 1410 is turned counter-clockwise, the portion 1442 moves within the slot 1325 such that the grove 1443 engages the edge 1600 and prevents the top 26 from being opened. In this non-limiting embodiment, the biasing spring 1320 allows the top 26 to remain in an open position unless forced to become locked, because the spring 1320 normally prevents engagement of slot 1443 with the edge 1600.

Further, in this non-limiting embodiment and when the locking member is in an unlocked state, the brackets 1340, 1342 each respectively receive a unique one of the flanges 1501 and these flanges 1501 do not prevent movement of the brackets 1340 because the respective biasing springs, such as spring 1502, prevent substantial engagement with the bracket 1340, 1342 and the respective flange 1501. When the lock member 1410 is moved to a locked position (i.e., when it is selectively rotated in a counter-clockwise manner) then each bracket 1501 contacts the respective edge 1690 of the bracket 1340 in which it resides and such contact prevents the respective doors 40, 48 from moving outwardly away from the interior cavity 22. The spring 1502 prevents contact between a flange 1501 and an edge 1690 until and unless the lock member 1410 is turned in a counter-clockwise direction.

Further, as is perhaps best shown in FIG. 16, the flanges 1301, 1303 usually and respectively reside within the bottom openings 1503 on members 1405, 1407 (the term "bottom" means those closest to the surface 200). When the assembly 12 is in an "unlocked" state, the flanges 1301, 1303 are free to move in and out of the respective openings 1503 that they reside within. When the lock member 1401 is selectively turned counterclockwise, the members 1405, 1407 move upwards in a direction opposite the surface 200 and such selective upward movement causes the edge 1710 of each such opening to engage a respective flange 1301, 1303 and prevent outward movement of the drawer 70. Thus, as described, a centralized locking system may lock all the movable drawers 70, 80,81,82,83,84; the top 26; and the side doors 40, 48 of the component 12 and this is achieved by a selective counter-clockwise turning of the lock member 1410 (i.e., a single centralized lock member).

Turning now to FIG. 41, it should be appreciated, as shown, that in an alternate embodiment of the invention, at least one gas spring 1800 may be deployed to assist the user in opening the top 820.

It is to be understood that the inventions are not limited to the exact construction which has been delineated above, but that various modifications may be made without departing from the spirit and the scope of the inventions as are more fully detailed in the following claims. Moreover, while the assembly 10 may be referred to as a "toolbox" assembly, it should be appreciated that a wide variety of dissimilar items, not just tools, may be stored within assembly 10. Also, a portable computer may be selectively and removably stored in drawer 840 and electrical power sockets may be selectively and removably placed anywhere in the assembly 10.

Figure 37:
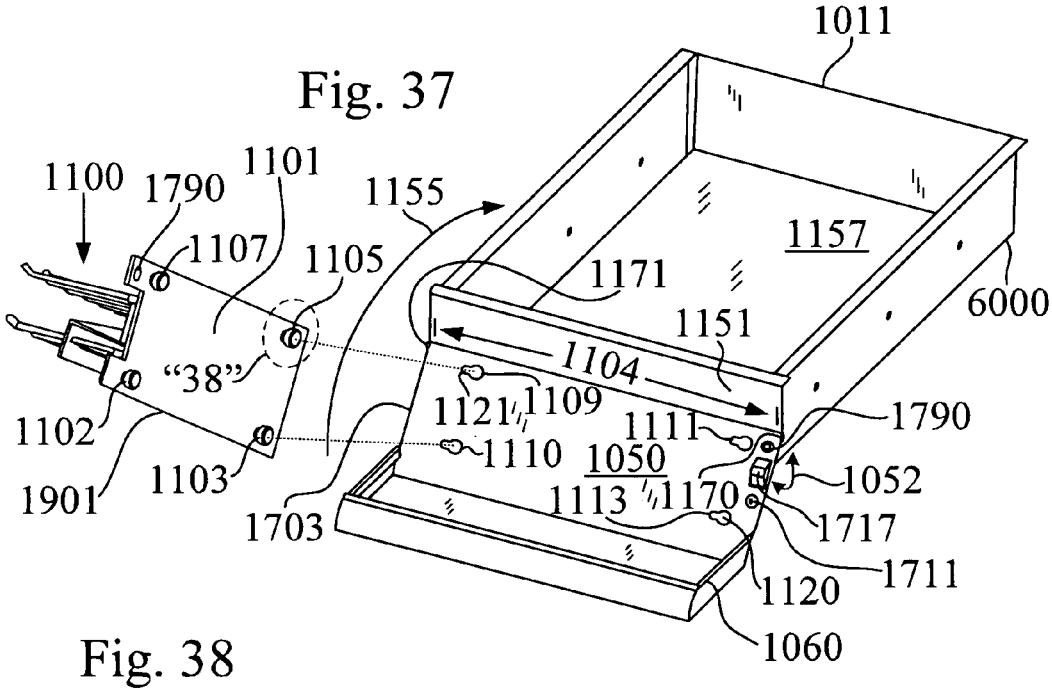
FIG. 37 is a perspective and enlarged and unassembled view of a seventh portion of the hutch portion which is shown in FIG. 26.
Figure 38:
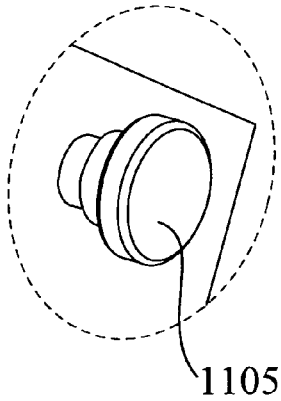
FIG. 38 is an enlarged view of a portion of the seventh portion which is shown in FIG. 37.
Figure 44:
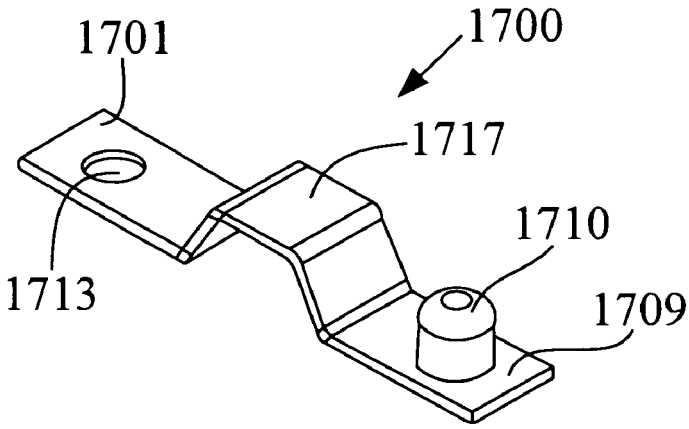
FIG. 44 is an exploded perspective view of the pin which is shown in FIG. 43.

In another non-limiting embodiment, as shown best in FIGS. 37 and 44, a pin 1700 is fastened, at end 1701, to the back surface 1703 of the angled portion 1050 and has a protuberance 1710 at free end 1709. The end 1701 may be fastened by a rivet or screw 1711 which passes through hole 1713. Further, in the fastening arrangement, the middle portion 1717 engages the surface 1703, and may even pass through the bracket 1050.

When the member 1101 selectively resides on portion 1050, the protuberance 1710 is made to reside in and through hole 1790 and a variety of non-limiting strategies may be used to ensure that protuberance 1710 stays within and through hole 1790, thereby, preventing portion 1100 from appreciably "sliding" along the surface of portion 1050 and being dislodged from portion 1050. One such technique involves the use of very rigid material to form pin 1700 making it relatively inflexible and prone or based to stay in a position in which protuberance 1710 passes through hole 1790 unless forcibly moved away from the hole 1710. Once the force is removed, the stiff pin 1700 will return to its original position. Thus, when placing portion 1101 on bracket 1050, the protuberance 1710 may be moved away from contact with portion 1101 and then protuberance 1710 will readily go through hole 1790.

Figure 45:
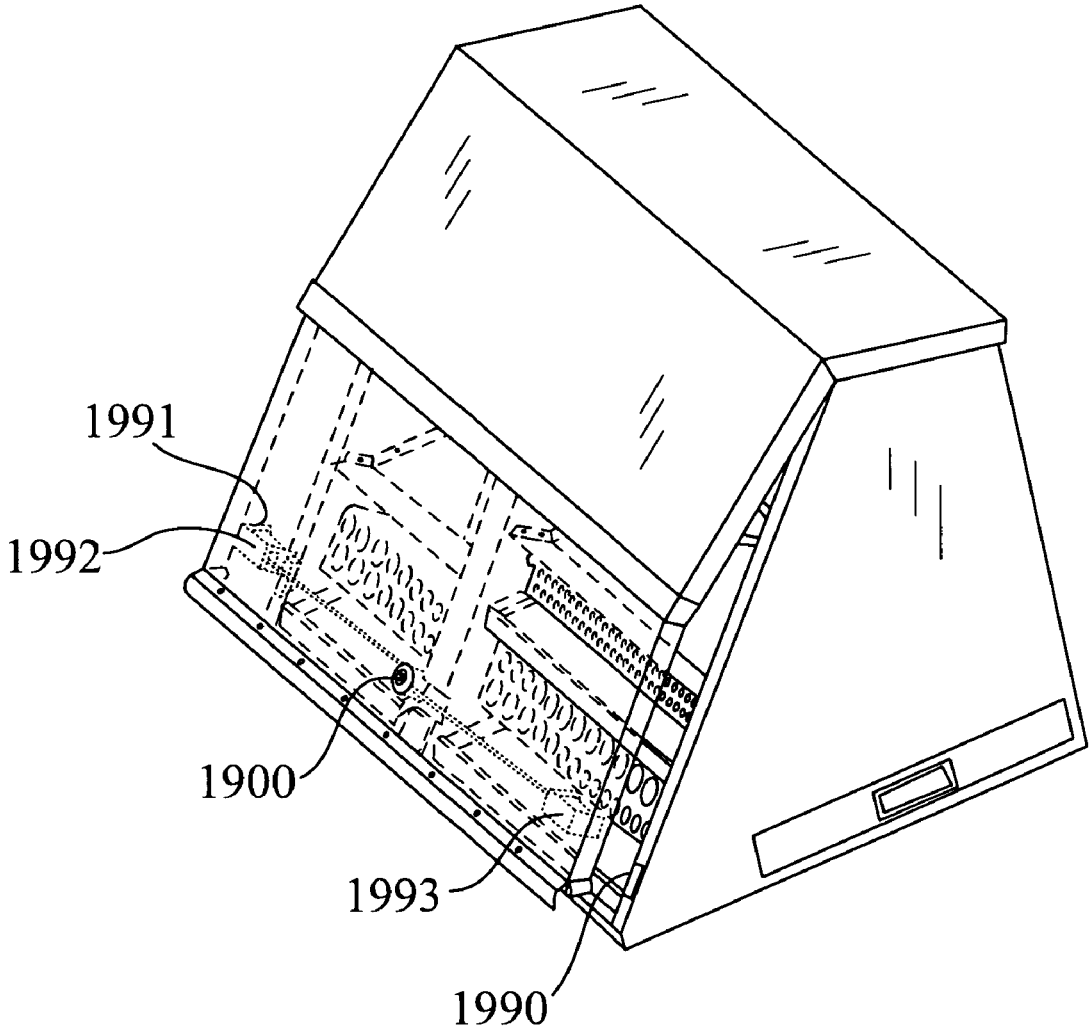
FIG. 45 is a perspective view of the hutch portion which is shown in FIG. 26 is combination with the lock portion which is shown in FIG. 42.

In another non-limiting embodiment, as perhaps shown best in FIGS. 42 and 45, a lock member 1900, similar to lock member 1410, may be deployed on portion 823, and is connected to opposed arms 1901, 1903. These arms move away from lock 1900 when the lock 1900 is part in a closed position and retract when the lock 1900 is part into an open position.

The hutch 800 includes opposed catch plates, 1990, 1991 and plungers 1992, 1993 are respectively placed on members 1901 and 1903. When the lock 1900 is put in a closed position, plungers 1992, 1993 respectively move in opposite directions away from lock 1990 and engage and are received by plates 1991 and 1990 thereby, preventing portion 823 from being opened. The plungers 1992, 1993 respectively disengage from the catch plates 1991, 1990 when the lock 1900 is opened, thereby, allowing the portion 823 to be opened. It shall further be apparent that in alternate and non-limiting embodiment, one or more magnets may be deployed within bracket 978 and 890 and 1050 to provide magnetic attractive force to whatever is selectively and respectively abutted to it or put in respective contact with it, thereby making for a more secure respective connection.

What is claimed is:

1. A hutch assembly comprising a generally hollow body; a first side drawer which is movably disposed within said body and which is selectively movable from a first closed position within said body to a second open position outside of said body; and a second side drawer which is coupled to said first drawer and which is movably disposed within said body and which is selectively movable from a first closed position within said body to a second open position outside of said body and wherein, when said first and second drawers both reside within said body, said first drawer is slidably and removably received within said second drawer and wherein each of said first and second drawers respectively move in opposite directions when said first and second drawers are respectively moved to said respective second positions and wherein said first and second drawers respectively move in opposite directions when said first and second drawers are respectively moved to said respective first positions and wherein said first drawer moves independently of any movement of said second drawer and wherein said second drawer moves independently of any movement of said first drawer; and further comprising a third drawer which is movably disposed within said body and which is selectively movable from a first closed position within said body to a second open position outside of said body and wherein such movement occurs in a direction which is different from said direction of movement of each said first and second drawers, and wherein said third drawer including a first surface which is covered by a pegboard, said hutch assembly further comprising a bracket having a flat back surface and wherein said flat back surface further having opposed first and second edges, said bracket further having a flat top surface which is linearly coextensive to and which orthogonally projects from said first edge and from said pegboard and which has a plurality of openings, said bracket further having a flat middle surface which terminates upon and which orthogonally projects from said pegboard and from said second edge, said flat middle surface having a second plurality of openings which are positioned below said first plurality of openings, and wherein said flat middle surface is parallel to said flat top surface and wherein said bracket further comprising a flat base portion which is coupled to said pegboard and which parallel to said flat top surface and said flat middle surface and which includes a central hinge member which allows movement of said bracket upon said pegboard.

2. The hutch assembly of claim 1 wherein said body further includes opposed end walls and wherein said hutch assembly further comprises a plate which is disposed within said body and above said first and second side drawers and which is coupled to each of said opposed end walls and wherein said hutch assembly further comprises a storage bracket having a flat top portion which is coupled to said plate; a second flat portion which projects from a first edge of said flat top portion and which forms an acute angle which said flat top portion; a third flat top portion which projects from a second edge of said flat top portion and which forms an obtuse angle with said flat top portion and wherein said first and second edges are parallel; and a ledge which is linearly coextensive to and which projects from said third flat portion and which includes a plurality of notches.

3. The hutch assembly of claim 2 further comprising third and fourth drawers which are each movably disposed within said body and each of which move in respective directions which are orthogonal to the direction which said first and second drawers move and wherein said hutch assembly further comprising a bracket which is coupled to a front surface of one of said third and fourth drawers and which forms an angle with said drawer which is greater than zero and which includes a top surface having a plurality of openings.

4. The hutch assembly of claim 2 further comprising third and fourth drawers which are each movably disposed within said body and which each move in respective directions which are orthogonal to the direction of said movement of said first and second drawers and wherein each of said third and fourth drawers has a respective flat surface and wherein said hutch assembly includes a pair of troughs which are respectively coupled to said flat surfaces of said respective third and fourth drawer.

5. The hutch assembly of claim 4 further comprising a first pin assembly which is coupled to said trough of said third drawer; and a second pin assembly which is coupled to said trough of said fourth drawer.

6. The hutch assembly of claim 1 further comprising an electrical power strip which is operatively disposed within said first drawer and wherein said first and second drawers move in respectively opposite directions when they are respectively moved outside of said body.

* * * * *